United States Patent [19]

Gentry

[11] Patent Number: 4,754,812

[45] Date of Patent: Jul. 5, 1988

[54] DUAL STRING PACKER METHOD AND APPARATUS

[75] Inventor: Mark Gentry, Spring, Tex.

[73] Assignee: Baker Oil Tools, Inc., Orange, Calif.

[21] Appl. No.: 28,742

[22] Filed: Mar. 23, 1987

[51] Int. Cl.[4] ..... E21B 23/00

[52] U.S. Cl. ..... 166/313; 166/120; 166/134; 166/182; 166/191; 166/387

[58] Field of Search ..... 166/313, 386, 387, 120, 166/121, 122, 134, 182, 191, 212

[56] References Cited

U.S. PATENT DOCUMENTS

| | | | |
|---|---|---|---|
| 3,098,524 | 6/1963 | Brown | 166/313 |
| 3,211,226 | 9/1965 | Myers et al. | 166/120 |
| 3,299,959 | 1/1967 | Brown | 166/120 |
| 3,414,058 | 12/1968 | De Rochemont | 166/120 |
| 3,658,127 | 4/1972 | Cochran et al. | 166/120 |
| 4,311,195 | 1/1982 | Mullins, II | 166/120 |
| 4,441,559 | 4/1984 | Evans et al. | 166/120 X |
| 4,505,332 | 3/1985 | Mills et al. | 166/120 |
| 4,526,229 | 7/1985 | Dickerson | 166/120 |
| 4,531,581 | 7/1985 | Pringle et al. | 166/120 |
| 4,657,084 | 4/1987 | Evans | 166/387 |
| 4,660,637 | 4/1987 | McGill et al. | 166/120 |

*Primary Examiner*—Stephen J. Novosad
*Assistant Examiner*—William P. Neuder
*Attorney, Agent, or Firm*—William C. Norvell, Jr.

[57] ABSTRACT

A packer, preferably utilized for dual string operations, comprising a plurality of axially stacked body elements including, from the bottom up, a hydraulic housing, a lower cone element, an annular slip cage containing radially expansible slip elements, an upper cone element, a lower packing expander, an expandable packing element, an upper packing expander, a receptacle, and a retainer plate. All of said elements are provided with two bores equal in diameter to that of the tubing string to be run which extend entirely through the axial stack. One bore accomodates a long string mandrel and the other bore accomodates a short string mandrel conventionally connected to a short tubing string. The short string mandrel is connected at one end to the hydraulic housing and at the other end to the receptacle housing. Fluid pressure is applied to concurrently effect the downward movement of the hydraulic housing and the upward movement of the lower cone to set the packer into engagement with the conduit wall. The packer is secured in set position by one or more locking rods detachably secured to the retainer plate and extending through the axially stacked assemblage to a unidirectional ratcheting connection with the lower cone element.

43 Claims, 13 Drawing Sheets

DUAL STRING PACKER METHOD AND APPARATUS

BACKGROUND OF THE INVENTION

1. Field of the Invention

The invention relates to a method and apparatus for effecting the packing of the annulus defined between one or more tubing strings and the casing bore of a subterranean well.

2. History of the Prior Art

In a typical dual well string installation, a packer is into and set within the well bore to close off the space about both strings above an upper production zone, and another packer beneath the dual packer and the lower end of one of the strings (known as the "short string") is lowered with the other string (known as the "long string") to seal thereabout below the upper zone but above the lower production zone. Thus, oil or gas from the upper zone is produced through the short string, and oil or gas from the lower zone is produced through the long string. As shown, for example, in U.S. Pat. No. 3,414,058, as well as on page 865 of the "1982–1983 Composite Catalogue of Oil Field Equipment and Services", dual string packers of this type normally comprise body means on which a packing element is supported and about which a slip assembly is carried, together with a pair of mandrels extending vertically within the body means and through side by side holes in the packing element so that each may be connected as a part of one of the well strings. Ordinarily, one of the mandrels is adapted to be temporarily closed so that, with the packer lowered to the desired position, hydraulic fluid may be supplied through the one mandrel to fluid pressure responsive means on the body means for causing relative vertical movement between sections of the body means above and below the packing element and slip assembly in order to move them into engagement with the well bore. See also U.S. Pat. Nos. 3,098,524; 3,211,226; 3,299,959; 3,658,127 and 4,505,332.

Packers of this type are not only expensive to manufacture but also time consuming to install since the upper portions of both tubing strings must be individually lowered into place. The provision of a separate body upon which the packing element is supported and about which the slip assembly is carried is a prime factor in raising the cost of manufacture of such prior art packers. Furthermore, such packers are characterized by a reduction in fluid passage area for at least one of the mandrels traversing the body of the packer. Any reduction in fluid passage area for a tubing string is obviously an undesired limitation on the use and productivity of the packer.

SUMMARY OF THE INVENTION

In accordance with the simplest form of the packing method and apparatus embodying this invention, the packer is fabricated by the stacked assembly of a plurality of generally cylindrical bodies. These bodies in turn are traversed by at least one bore accommodating a mandrel. A second bore accommodates a locking rod, which traverses all of the bodies except the uppermost and lowermost.

The various cylindrical bodies or elements comprise from the bottom up, a hydraulic housing element, a lower cone element, an annular slip cage element, an upper cone element, a first expander element, an elastomeric packing element, a second expander element, a receptacle housing element, and a locking rod retainer plate. A plurality of slips are radially shiftably mounted in the cage element in peripherally spaced relation. Thus, when the aforedescribed elements are disposed in axially stacked abutting relationship, as by inserting a hollow mandrel through the first bore, and an axial compressing force is applied between the hydraulic housing element at the bottom and the receptacle housing at the top, a compression of the elastomeric packing element by the first and second expander elements occurs, thus deforming the elastomeric packing element radially outwardly into sealing engagement with the well bore. Concurrently, the upper and lower cone elements engage the slips mounted in the slip cage element and urge such slips radially outwardly into biting engagement with the well bore.

Such relative movement is conveniently accomplished by a cylinder bore formed in the hydraulic housing element which is concentric with the locking rod bore and open only at its upper end. A piston having a closed bottom end is inserted in the cylinder bore and has an open upper end concentrically disposed with respect to the locking rod bore. The upper end of the piston abuts the lower face of the lower cone element under the influence of fluid pressure supplied to the cylinder bore and urges the lower cone element upwardly. Concurrently, the hydraulic housing element is urging the mandrel mounted in the first bore traversing the aforementioned elements in a downward direction. Such mandrel is also connected to the receptacle housing and moves such housing downwardly, thus effecting compression of the elastomeric packing element and expansion of the radially shiftable slips disposed in the slip cage element.

The locking of the entire assembly in its expanded or set position is accomplished by a locking rod which extends through the second bore provided in the various axially stacked elements except the retainer plate at the top and the hydraulic housing at the bottom. Such rod is detachably secured to the retainer plate which overlies the top surface of the receptacle housing and is shearably connected thereto. The locking rod 15 is moved downwardly by an abutting connection with the receptacle housing. The lower end of the locking rod projects into the hollow upper end of the piston and is provided with wicker threads. A conventional body lock ring cooperates with the wicker threads on the bottom end of the locking rod and with threads provided on the interior of the hollow portion of the actuating piston. Thus, as the assembly is compressed, the body lock ring secures the entire assembly in its compressed position by effectively locking the bottom end of the locking rod to the bottom portion of the lower cone element.

The structure heretofore described contemplated a packer employing only a single tubing string and a single locking rod. The construction of such packer is, however, uniquely suited for a dual string packing element wherein two mandrels having a flow passage area of equal size to the separate tubing strings are respectively mounted in two bores disposed in side by side, parallel relationship and traversing all of the axially stacked elements heretofore mentioned. With this construction, it is convenient and expedient to employ two more parallel bores through all the axially stacked elements except the retainer plate and the hydraulic housing to respectively mount two locking rods with their axes lying in a plane perpendicular to the plane defined by the axes of the mandrel bores. Thus, the top portions of the two locking rods are detachably secured to the retainer plate, while the lower portions are each respectively connected through a body lock ring to the upper hollow portions of two pistons which cooperate with two open top bores formed in the hydraulic housing element which are concentric with the locking rods. Thus, the hydraulic force available to set the packer has been effectively doubled without reducing the flow area of the two mandrels which are respectively connected to conventional long and short tubing strings of the well. Both mandrels are always rotatable relative to the packer body elements to facilitate operation of other downhole tools connected to the mandrels.

Another feature of this invention lies in the utilization of the pressured fluid acting in the hydraulic housing element to exert an additional downward force on one of the mandrels, which is generally the short string mandrel, and that mandrel is utilized to transmit the total downward hydraulic forces to the receptacle housing and thus move the receptacle and the abuttingly attached locking rods downwardly to effect the necessary compression of the axially stacked elements to produce the setting of the packer. A removable plug is sealably connected in the short string mandrel at a location below conduits in the hydraulic housing which communicate between the bore of the short string mandrel and the fluid pressure chambers defined by the open top bores formed in the hydraulic housing element.

When the packer construction embodying this invention is utilized for a dual string packer, both strings may be inserted in the the well at the same time. The long string is preferably releasably connected to one of the axially stacked elements, such as the hydraulic housing element, and functions to effect the lowering of the packer into position. The long tubing string also shearably mounts a shock absorbing unit below the hydraulic housing. The short string mandrel is connected to the hydraulic cylinder element at its lower end and to the receptacle housing at its upper end, thus maintaining the above listed elements in their axially stacked relationship. More importantly, the tubing string connected to the short string mandrel incorporates an expansion joint in the tubing string above the short string mandrel so as to permit such mandrel to move downwardly upon fluid pressure activation of the setting mechanism.

Such packer may be readily retrieved from the well b upward movement of the long tubing string. Such upward movement shears the shearable connection to the hydraulic housing element and then the shearable connection to the shock absorbing unit. An abutment ring on the mandrel connected to the long tubing string is then moved upwardly into engagement with a shoulder formed on the retainer plate. The application of sufficient upward force to the long tubing string will effect a shearing of the shearable means by which the retainer plate is secured to the receptacle housing. The release of the retainer plate from the receptacle housing permits the detachable connection of the retainer plate to the upper ends of the locking rods to be released and all tension forces relieved from such rods; thus the compressive forces existing in the packed off elements are instantly relieved. Further upward movement of the mandrel connected to the long string brings still another shoulder into abutting engagement with the receptacle element and effects the movement of the entire packer assemblage from the well.

In accordance with a preferred embodiment of this invention, a sleeve piston is disposed intermediate the upper end of each of the locking rods and the bores of the upper and lower expander elements and the intermediate elastomeric packing elements. Each piston sleeve is axially movable relative to the locking rods on which it is assembled, and is sealably engaged between the periphery of the locking rod and the bores of the elastomeric sealing elements within which it is mounted. Accordingly, anytime that the well annulus fluid pressure below the expanded elastomeric sealing elements exceeds the well annulus pressure above the expanded elastomeric seal elements, the piston sleeve will be forced upwardly. The sleeve is rigidly connected to the lower expander element at its bottom end and thus an additional compressive force is imparted to the elastomeric packing elements. This additional compressive force is trapped within the elastomeric packing elements by the provision of ratcheting threads on the upper ends of the locking rods which extend downwardly into the upper ends of the piston sleeves respectively and are operatively connected to the piston sleeves for a unidirectional locking action by conventional body lock rings. Thus, the packer has the further advantage of being more tightly compressed into sealing engagement with the well or casing bore in the event of any buildup in annulus pressure below the expanded packing element.

Further objects and advantages of the invention will be readily apparent to those skilled in the art from the following detailed description, taken in conjunction with the annexed sheets of drawings, on which is shown a preferred embodiment of the invention.

DESCRIPTION OF PREFERRED EMBODIMENT

Figure 2A:
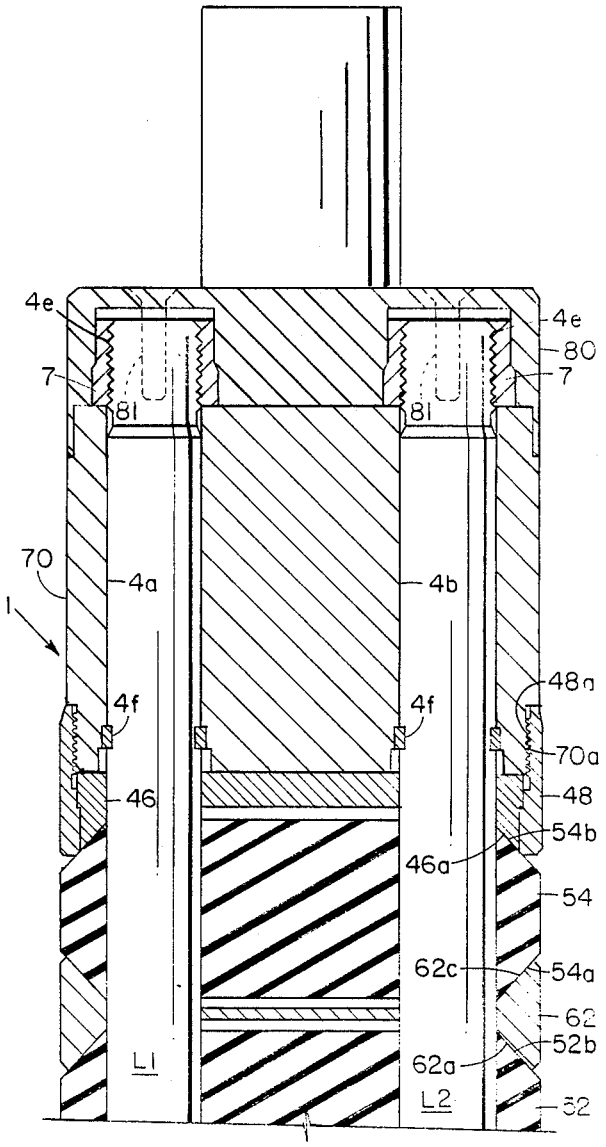
FIGS. 2A, 2B, and 2C collectively represent a vertical sectional view of the packer of FIGS. 1A–1C but taken on plane at a 90° displacement relative to the sectional plane of FIGS. 1A–1C.
Figure 2B:
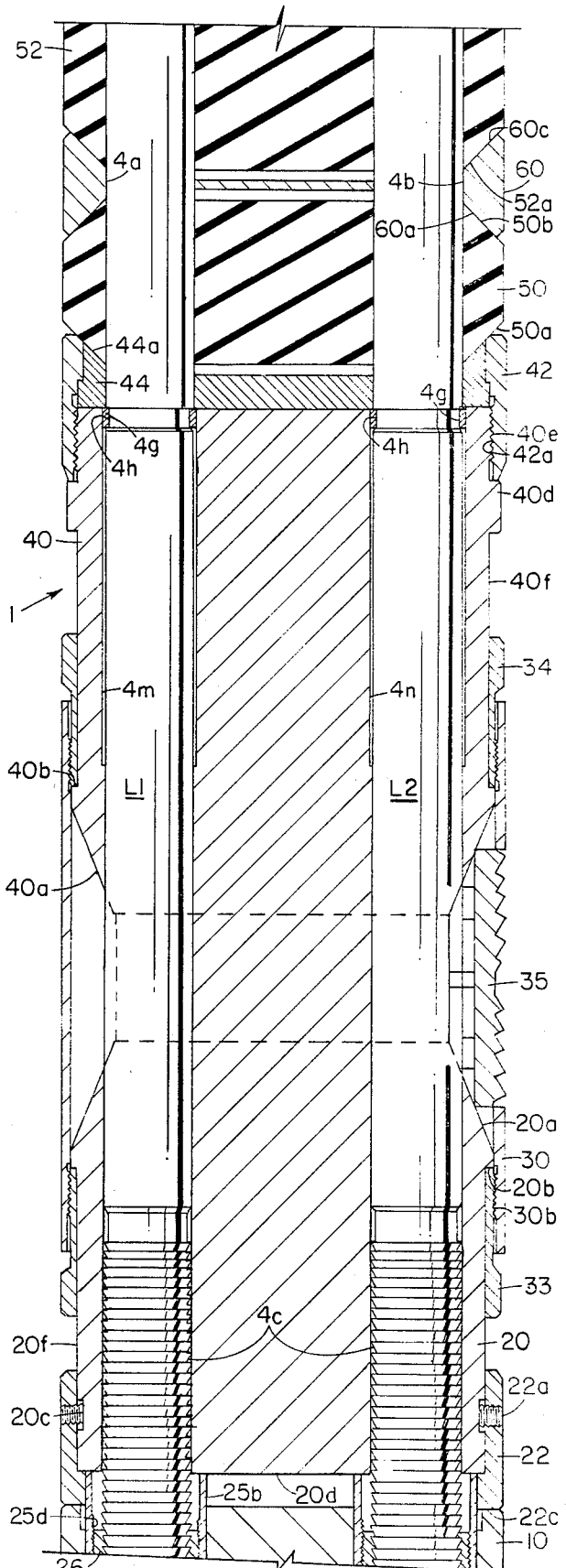
Figure 5A:
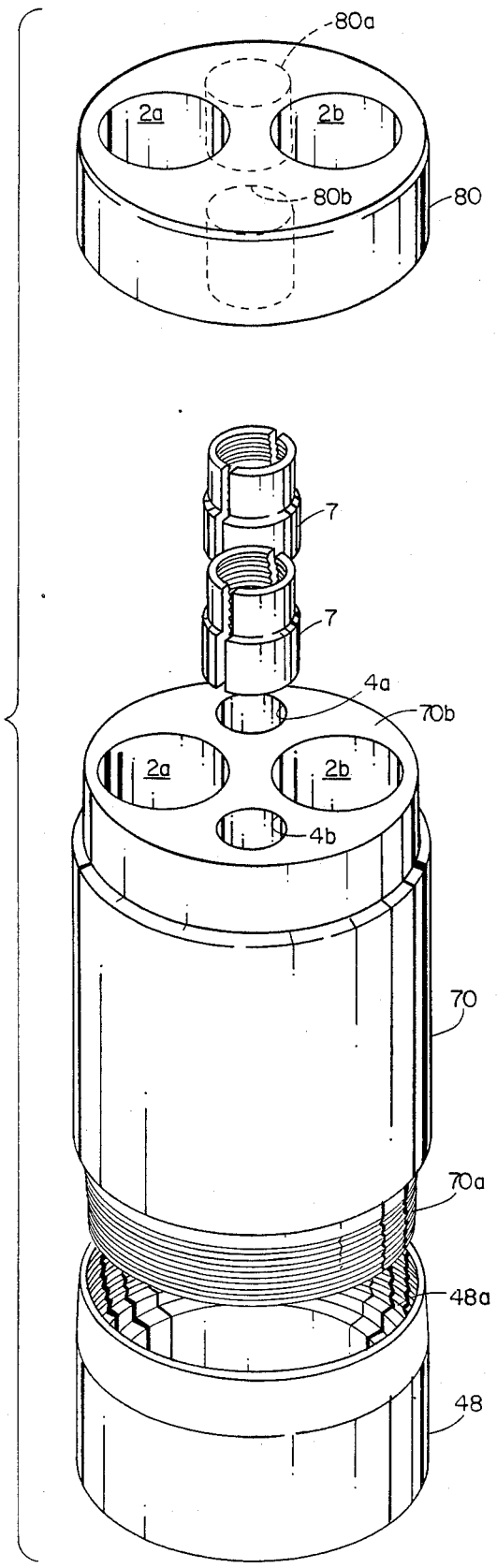
FIGS. 5A, 5B, 5C, 5D, 5E and 5F collectively constitute an exploded perspective view of the major body components of the packer shown in their vertically stacked relationship, but with the tubing strings and locking rods omitted for clarity of illustration.
Figure 5B:
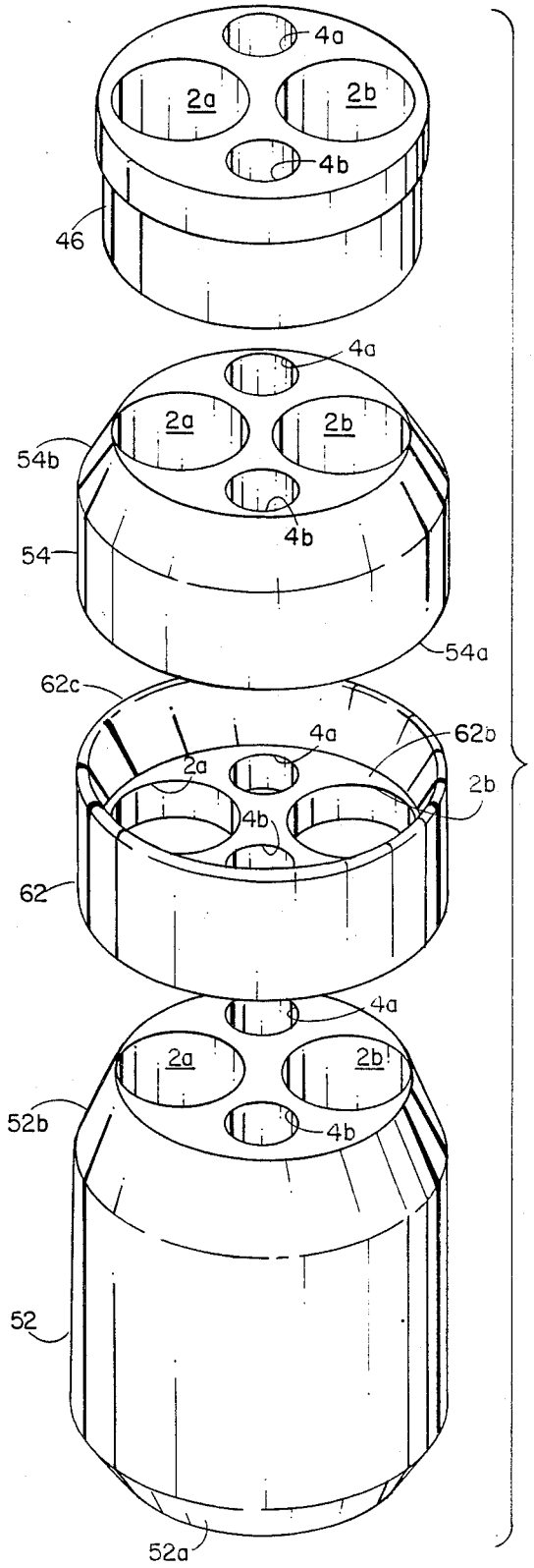
Figure 5C:
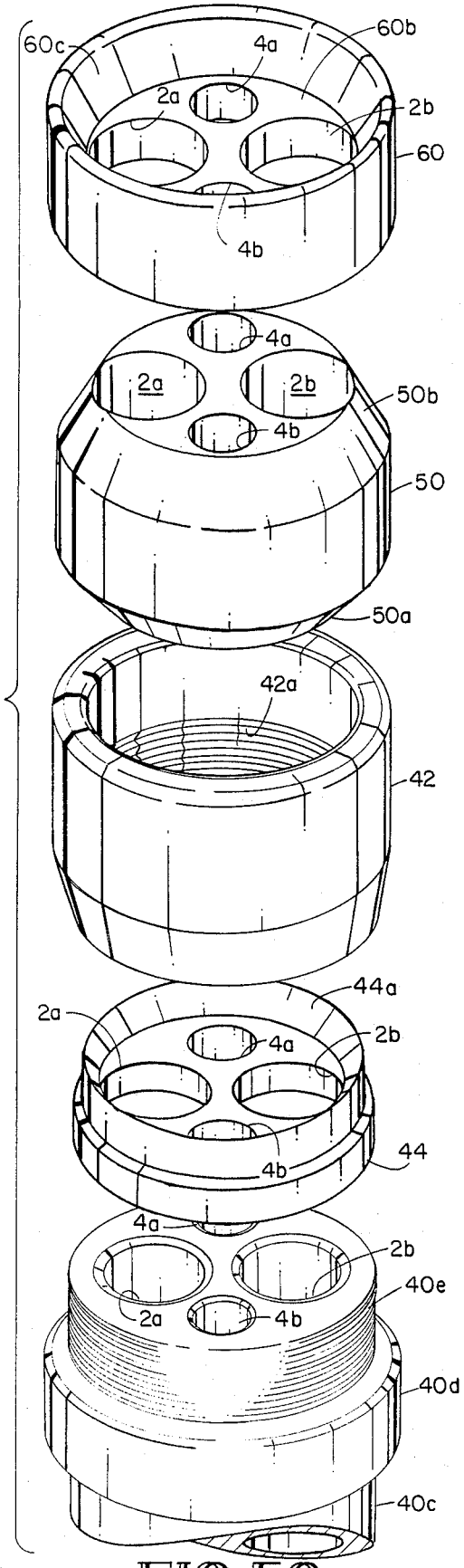

Essentially a packer 1 embodying the method and apparatus of this invention comprises a plurality of verticall stacked, generally cylindrical body elements which, for clarity of illustration are shown in exploded perspective views 5A, 5B, 5C, 5D, 5E and 5F. Such exploded perspective views are necessarily schematic and are provided merely to assist the reader to understand the major body components comprising the packer and their vertical relationship to each other. Thus, beginning at the bottom of the packer, or in other words with FIG. 5F, the first major body component of the packer is a hydraulic housing 10. A gauge ring 12 is secured to the bottom end of hydraulic housing 10 by external threads 1Og provided on the housing. A mandrel locking housing 14 is secured within gauge ring 12 by an internally projecting shoulder 12a (FIG. 1C and 2C).

Hydraulic housing 10 and mandrel locking housing 14 are provided with two radially spaced mandrel bores 2a and 2b and these same numerals will be applied to all corresponding aligned mandrel bores provided in the other body components of the packer. In 90° spaced relationship to the mandrel bores 2a and 2b, the hydraulic housing 10 is provided with two cylinder bores 1Oa and 1Ob (FIG. 2C) which do not extend entirely through the cylinder housing 10 but are open only at their upper ends. Cylinder bores 1Oa and 1Ob are respectively coaxial with locking rod receiving bores 4a and 4b provided in many of the other body elements of the packer 1.

Figure 5D:
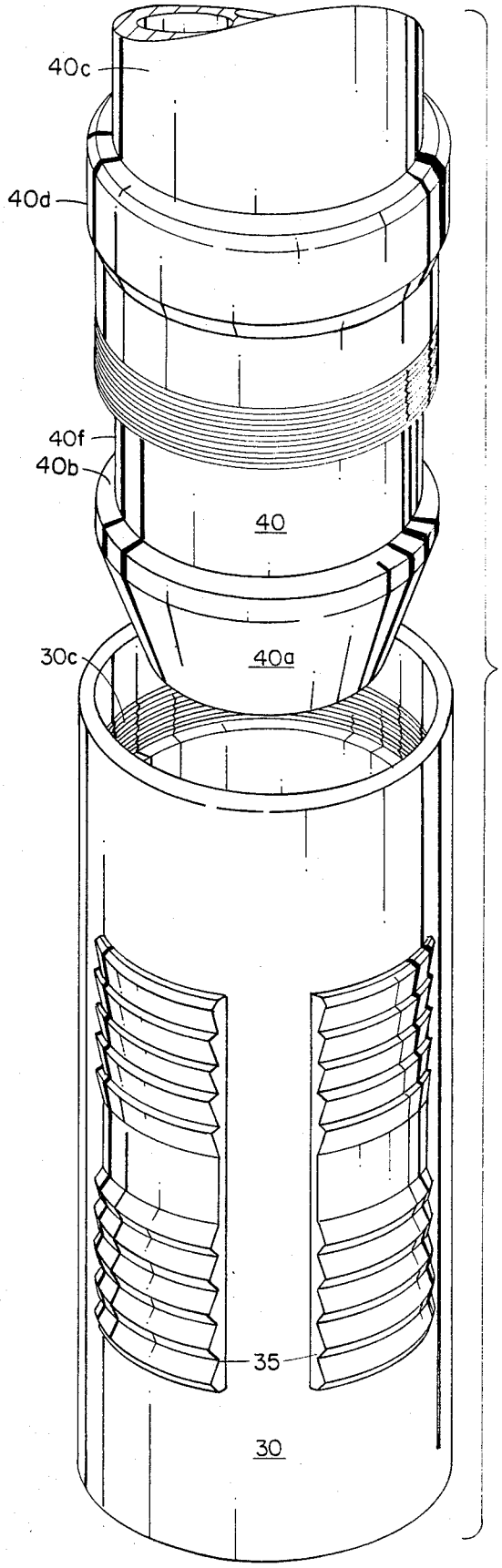
Figure 5E:
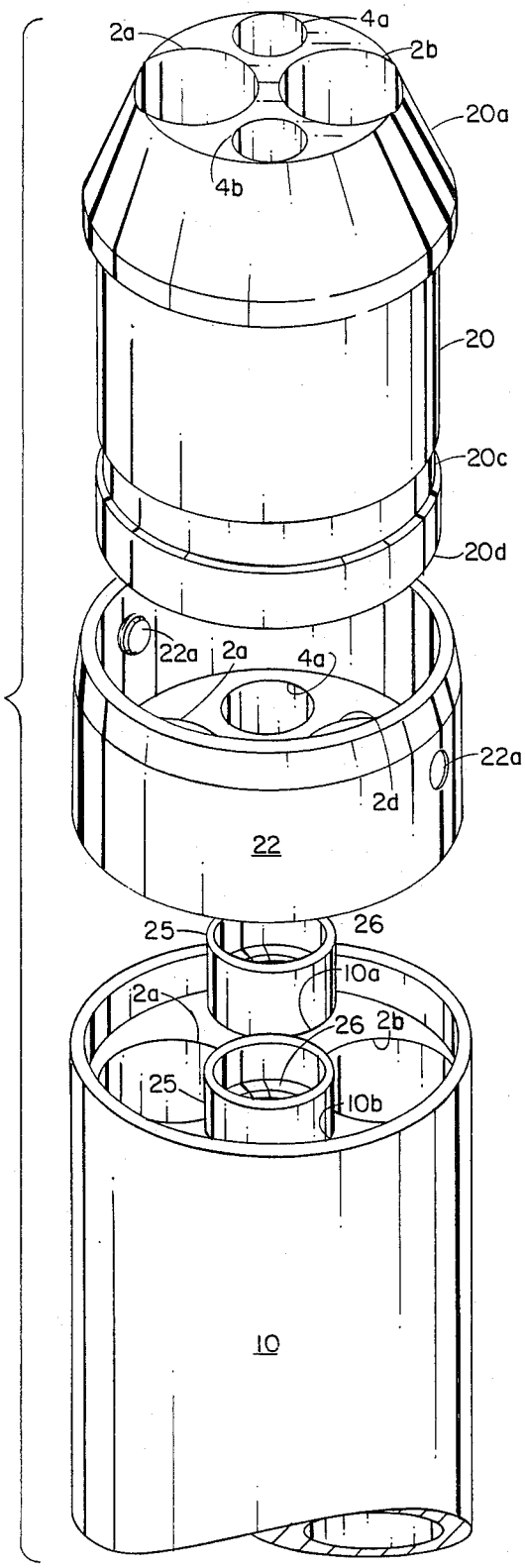
Figure 5F:
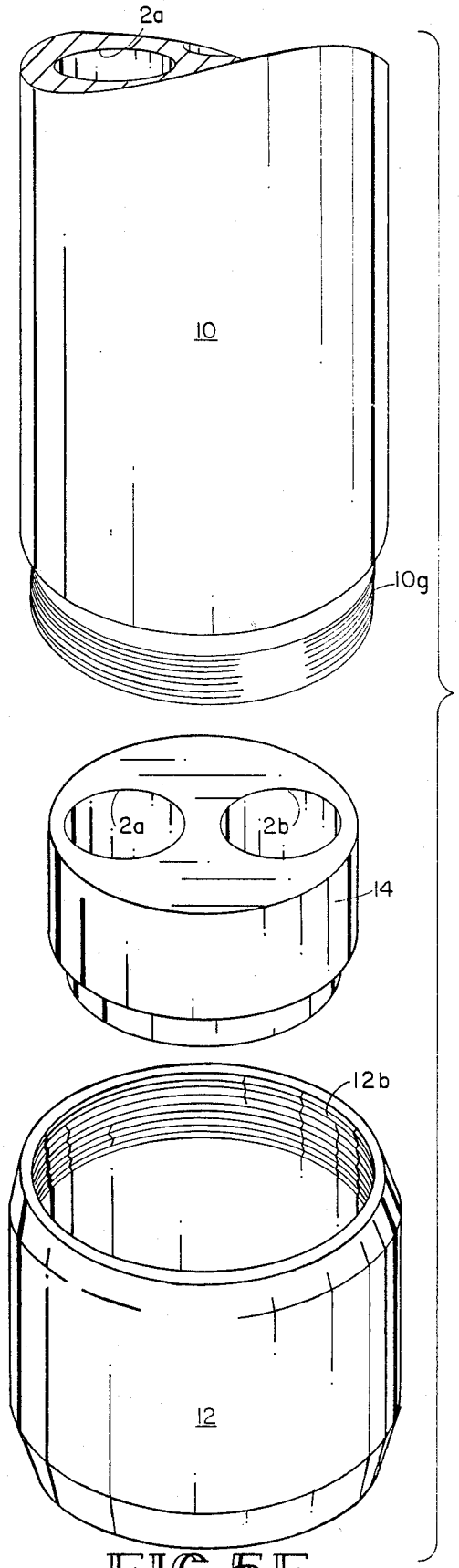

Proceeding upwardly, as shown in FIG. 5E, the next major body component is a lower cone element 20 to which a gauge ring 22 is detachably secured by a plurality of peripherally spaced shear screws 22a engaging peripheral groove 20c. Lower cone element 20 is provided with the parallel tubing bores 2a and 2b and also with locking rod receiving bores 4a and 4b, with all of such bores extending entirely through the lower cone element 20 and the gauge ring 22. The upper end of lower cone element 20 defines an upwardly facing inclined surface 20a which cooperates with one end of a set of peripherally spaced slips 35 carried in the annular slip cage 30 which constitutes the next major body element of the packer and is shown in FIG. 5D.

The annular slip cage 30 (FIGS. 1B and 10) defines a plurality of peripherally spaced rectangular slots 30a in its side wall within which are conventionally mounted a plurality of double acting slips 35. Radial bolts 31 are provided only to facilitate assembly of the slips and are then removed. As shown in more detail in FIG. 1B, each slip 35 is provided with a downwardly facing inclined surface 35b which cooperates with the upwardly facing inclined surface 20a formed on the upper end of the lower cone element 20. Each slip element 35 is also provided with an upwardly facing inclined interior surface 35c which cooperates with a similarly inclined, downwardly facing surface 40a provided on the bottom end of the next major body element of the packer, namely, the upper cone element 40 which is also shown in FIG. 5D. Neither the lower cone element 20 nor the upper cone element 40 is rigidly attached to the cage 30 so that relative movement of lower cone element 20 upwardly toward upper cone element 40 will produce a radially outward displacement of the slip elements 35 to effect the setting of the packer 1.

The internal threads 30b and 30c provided respectively at each end of the annular slip cage 30 are employed for the securement thereto of lower and upper mounting rings 33 and 34, (FIG. 1B), the ends of which respectively abut downwardly facing shoulder 20b formed on the lower cone element 20 and upwardly facing shoulder 4Ob provided on the upper cone element 40. Such rings are, however, slidable respectively on the cylindrical portions 20f and 40f of the lower cone element 20 and the upper cone element 40 and hence do not interfere with relative movement of such cone elements toward each other during the setting of the packer 1.

As shown in FIGS. 5C and 5D, the upper cone element 40 has an upwardly extending cylindrical portion 40c terminating in a radially enlarged shoulder 40d and a reduced diameter externally threaded portion 40e. External threads 40e are employed for the mounting thereon of a gauge ring 42 having internal threads 42a. Snugly mounted within the bore of the annular gauge ring 42 is a force transmitting or expander body 44. Upper cone element 40 and body 44 are provided with apertures 2a and 2b, and 4a and 4b in alignment with the other correspondingly numbered apertures in the other packer body components. Additionally, the top end surface of force transmitting body 44 is provided with an upwardly facing inclined surface 44a which engages the lower, similarly inclined downwardly facing surface 5Oa of a first annular elastomeric sealing element 50. The upper face 50b of annular elastomeric sealing element 50 is inclined upwardly and outwardly and is engaged by a similarly inclined lower surface 60a provided on spacer body 60. It should be noted that the central portions 60b of spacer body 60 are of substantially diminished axial thickness. Sealing element 50 and expander body 60 are both provided with the axial apertures 2a, 2b, 4a and 4b.

The upwardly facing surface 60c of spacer body 60 is inclined upwardly and outwardly and engages the similarly inclined lower surface 52a of an intermediate or central elastomeric packing body 52. Packing body 52 is provided with the same set of aligned apertures 2a, 2b, 4a and 4b as have been heretofore described in connection with the other body elements of the packer.

The upper surface of the intermediate elastomeric sealing body 52 is inclined as indicated at 52b and such inclined surface cooperates with a second spacer element 62 which is identical to the spacer element 60, having an inclined peripheral bottom surface 62a, a relatively thin central body portion 62b, and an inclined top surface 62c. Central body portion 62b is provided with apertures 2a, 2b, 4a and 4b which are respectively alignable with the corresponding apertures in the previously described components.

The upper inclined surface 62c of spacer 62 is in abutment with a similarly inclined downwardly facing surface 54a provided on an upper elastomeric packing element 54. Packing element 54 is provided with axially extending apertures 2a, 2b, 4a and 4b in the same manner as the components previously described. Additionally, upper elastomeric body element 54 is provided with an upwardly facing inclined surface 54b which is in abutting engagement with the similarly inclined downwardly facing surface 46a of a force transmitting body 46 (FIG. 2A). Force transmitting body 46 is held in position by a gauge ring 48 having internal threads 48a which are threadably engaged with external threads 70a provided on the lower end of a receptacle housing 70. Both receptacle housing 70 and the force transmitting body 46 are provided with the same axial apertures 2a, 2b, 4a and 4b as in the previously described components Lastly, a locking rod retainer plate 80 is provided which overlies the top face 70b of receptacle housing 70. As will be described in more detail later, the retainer plate 80 is secured to housing 70 by one or more axially disposed shear screws 81 as shown in dotted lines in FIG. 2A. Retainer plate 80 is provided with the same mandrel apertures 2a and 2b as are the previously described components, but is not provided with through passages corresponding to the bores 4a and 4b found in the lower components. Instead, the retainer plate 80 is provided with downwardly opening bores 80a and 80b which are concentric with the axes of the rod passages 4a and 4b provided in the other components. Axially split, internally threaded locking bushings 7 are mounted in bores 8Oa and 80b.

From the foregoing description, it will be apparent that the body elements heretofore mentioned may be axially stacked by being assembled on one or more hollow mandrels. For a dual string packer, the short string and long string mandrels SM and LM (FIGS. 1A, 1B and 1C) are respectively disposed in the apertures 2a and 2b and such mandrels are freely rotatable in such bores. Axial movements of the mandrels relative to the body components are, however, restricted in a manner to be hereinafter described.

The aligned rod bores 4a and 4b are employed to permit the free passage therethrough of locking rods L1 and L2 (FIGS. 2A, 2B and 2C) which, as will be later described, are detachably abuttingly secured to the receptacle housing 70 by bushings 7 in retainer plate 80 and project downwardly through the entire assembly to end in an outwardly projecting position relative to the bottom face 22c of the gauge ring 22 secured to the lower cone element 20. Locking rods L1 and L2 are employed for the purpose of locking the axially stacked body elements of the packer in a compressed position, resulting from downward movement of the receptacle 70 concurrently with upward movement of the lower cone element 20. The structure for effecting such setting movement will now be described in connection with the longitudinal sectional views of FIGS. 1A, 1B, 1C, 2A, 2B, 2C, 3A, 3B, 3C, 4A, 4B and 4C.

Figure 1A:
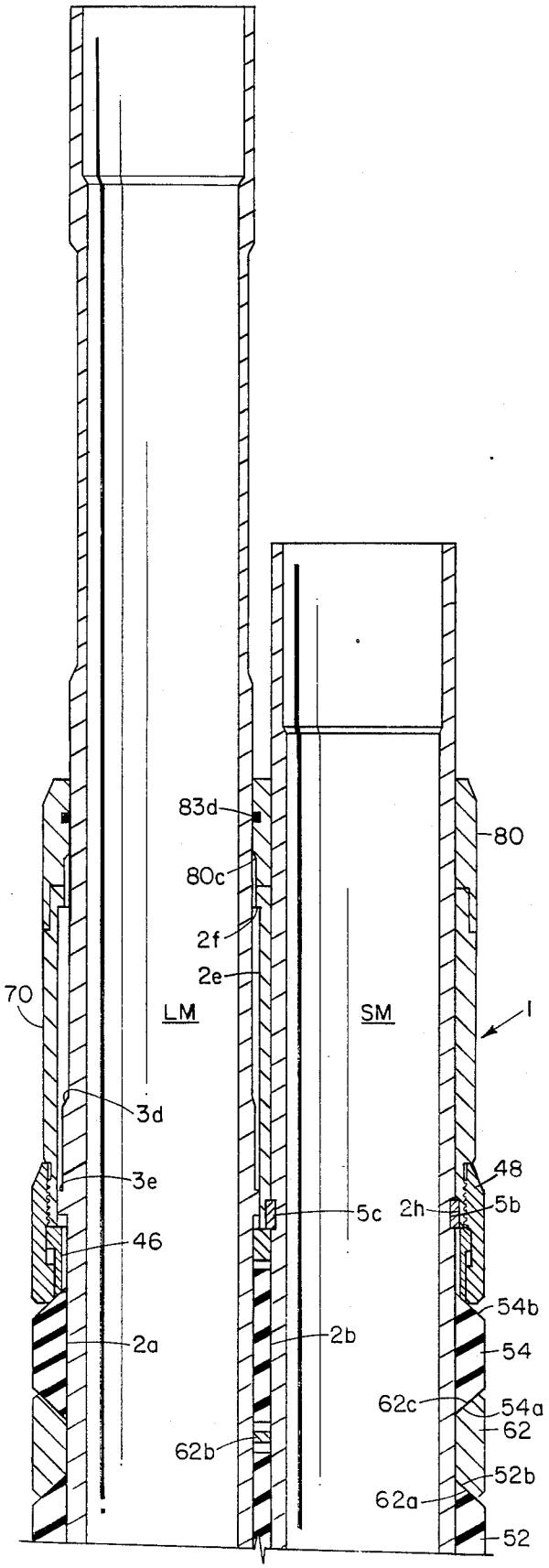
FIGS. 1A, 1B, and 1C collectively represent a vertical sectional view of an assembled packer embodying this invention, with the elements of the packer shown in their non-expanded or run-in positions.
Figure 1B:
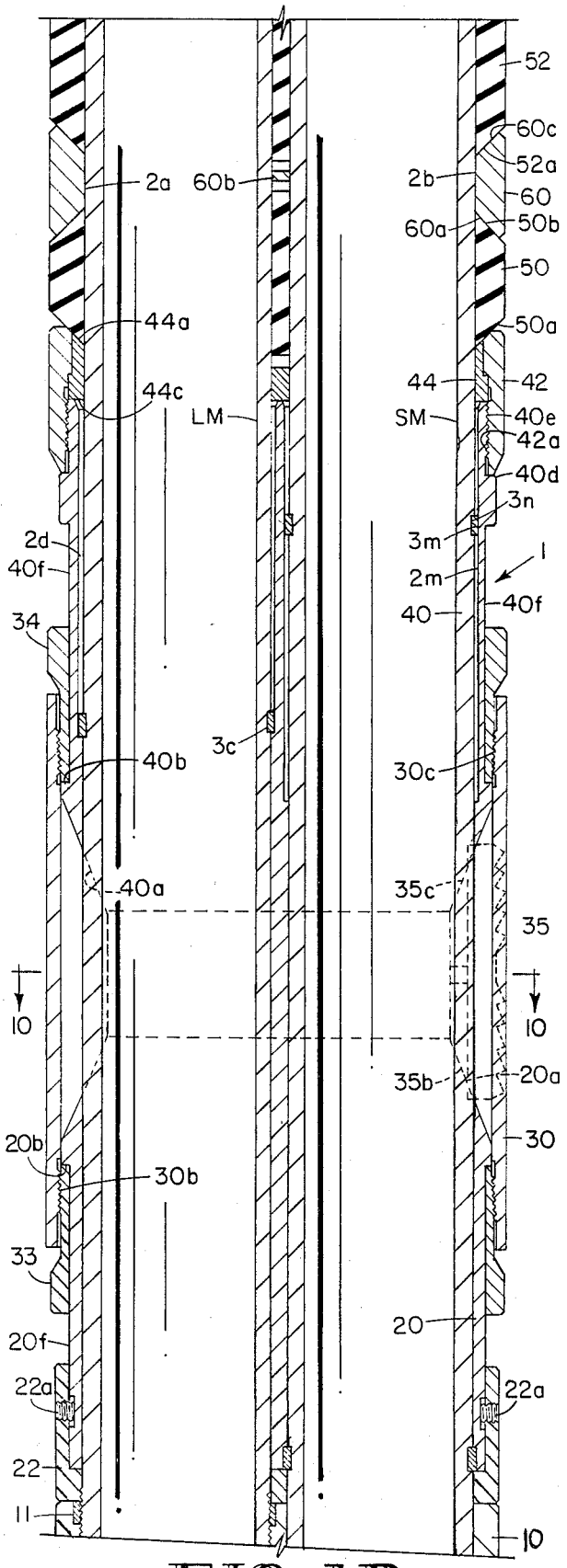
Figure 1C:
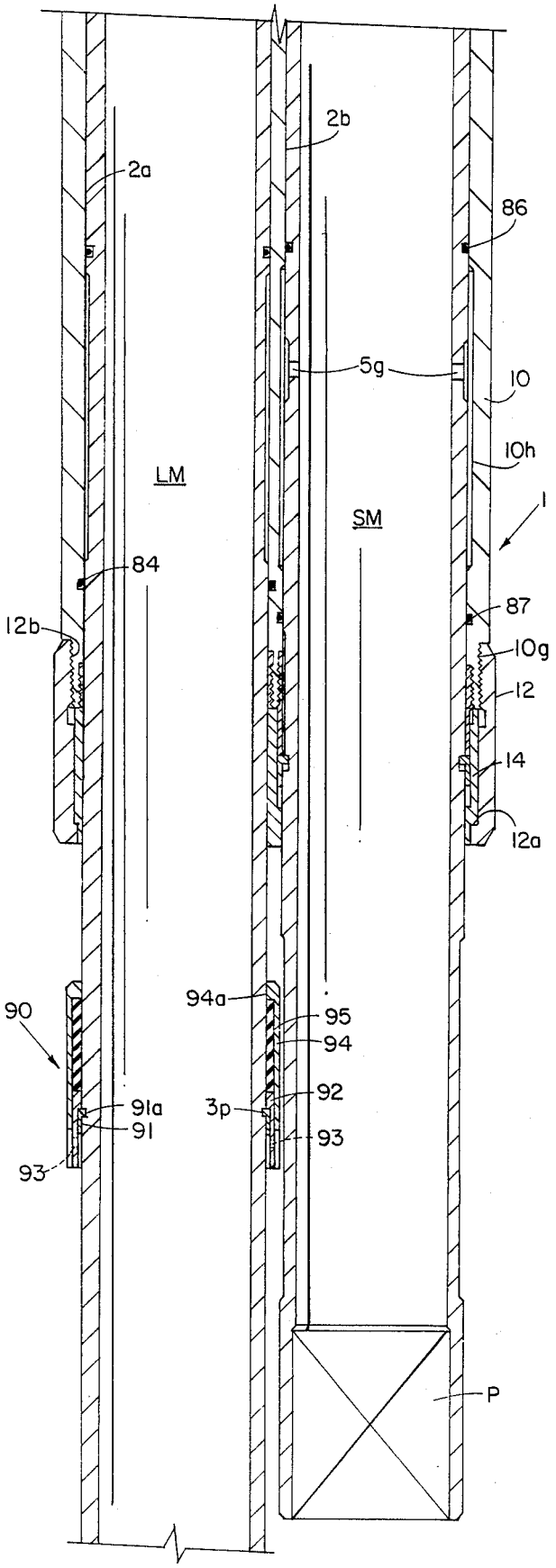
Figure 2C:
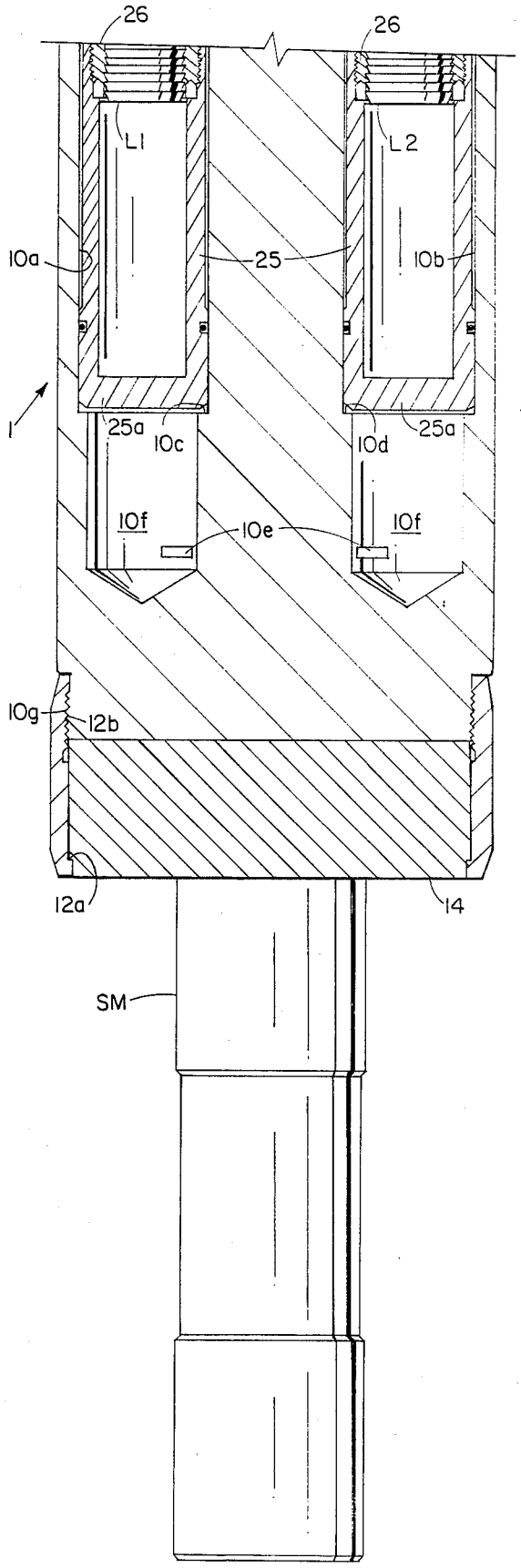
Figure 3A:
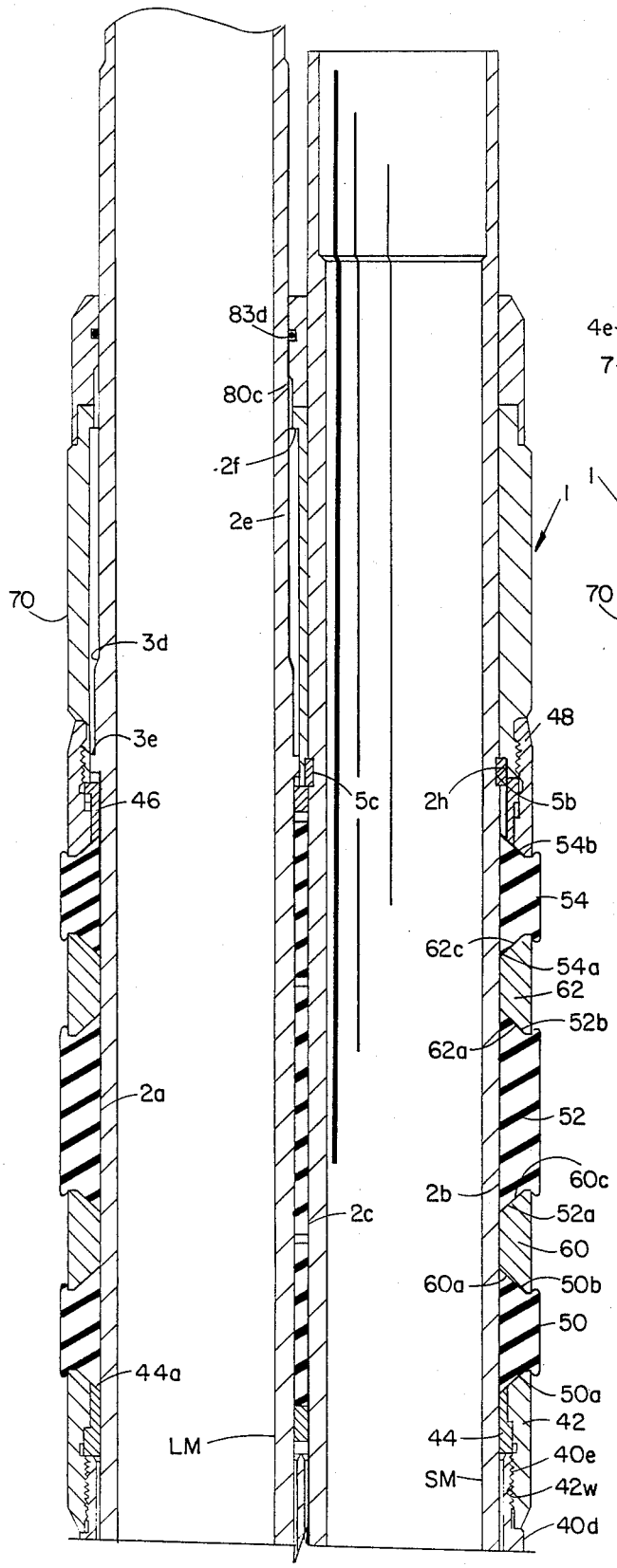
FIGS. 3A, 3B, and 3C comprise vertical sectional views respectively similar to FIGS. 1A, 1B, and 1C, but illustrating the position of the elements of the packer in their expanded or set position.
Figure 4A:
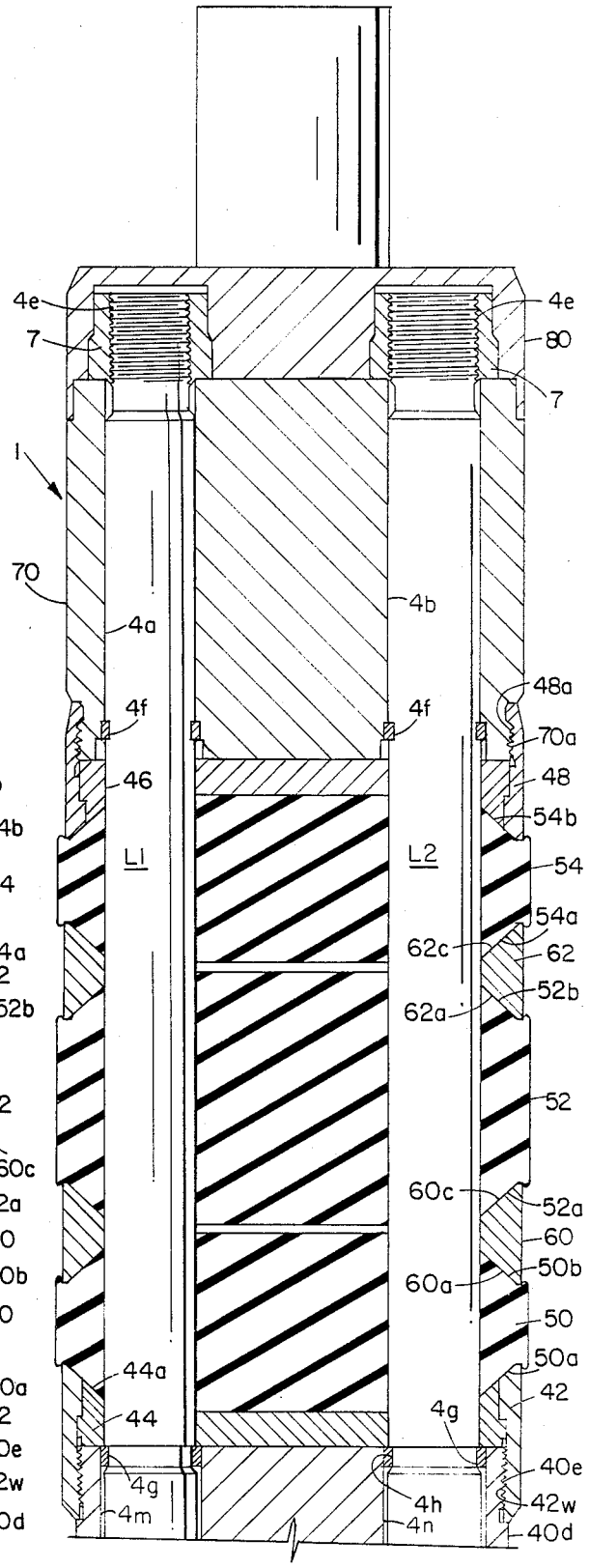
FIGS. 4A, 4B, and 4C comprise views respectively similar to FIGS. 2A, 2B, and 2C, but illustrating the elements of the packer in their expanded or set position.
Figure 3B:
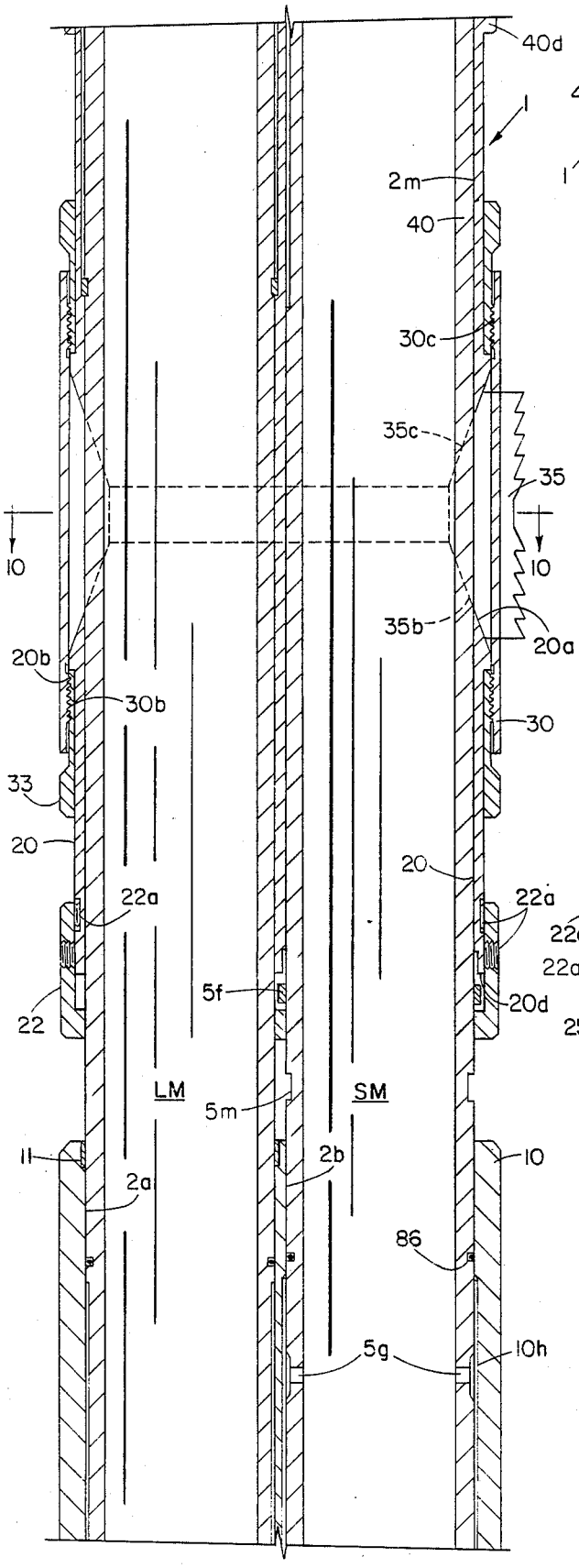
Figure 4B:
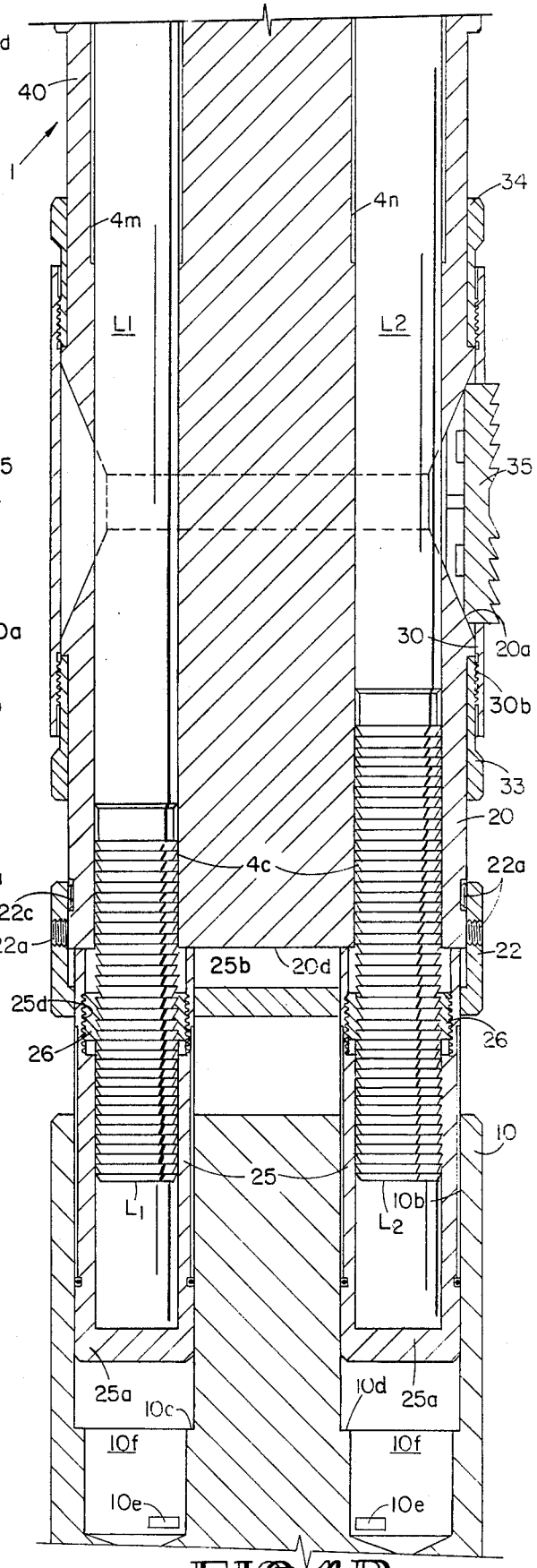
Figure 3C:
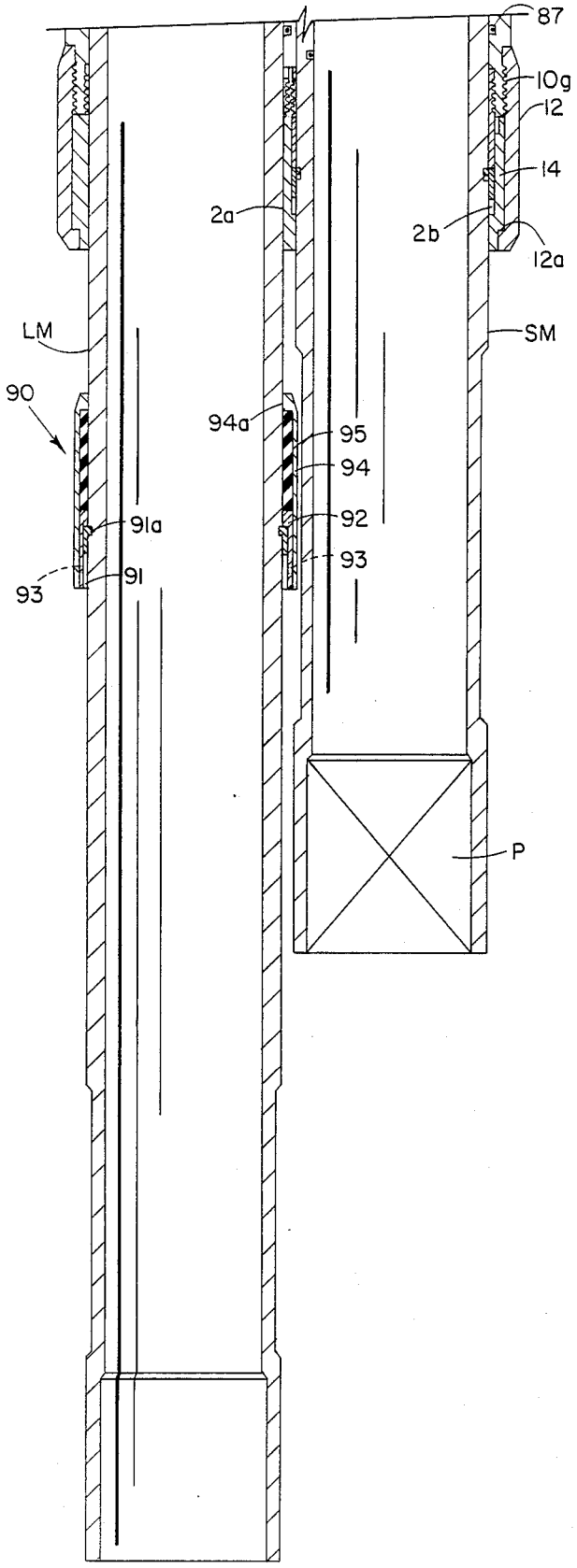
Figure 4C:
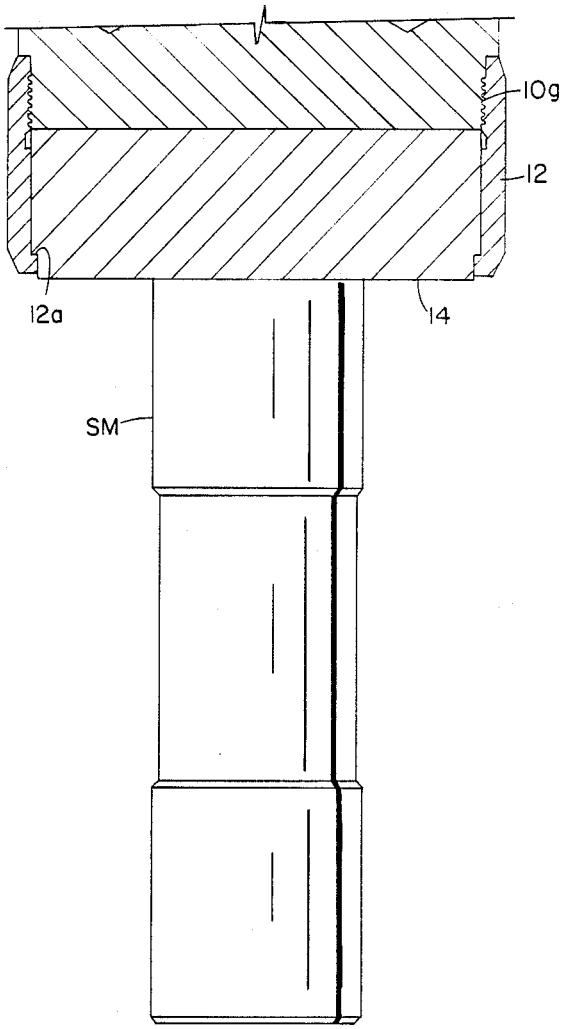

Referring first to FIGS. 1A, 1B and 1C, the connection of the long string mandrel LM and the short string mandrel SM to the packer body components will be described. It is conventional to connect the upper end of the long string mandrel LM to the bottom end of a tubing string (not shown) by which the packer 1 is lowered into position in the well bore. The packer embodying this invention preferably has the short string mandrel SM also connected to a tubing string (not shown) during the runing and the setting of the packer, and a conventional expansion joint (not shown) is incorporated in the tubing string to which the short string mandrel SM is connected. Such expansion joint will permit the downward displacement of the short string mandrel which is required in the setting of the packer in the manner to be hereinafter described. Mandrels LM and SM are of course respectively inserted in the mandrel bores 2a and 2b.

For the purpose of lowering the packer 1 into the well by the tubing string connected to the long string mandrel LM, such mandrel should be detachably connected to any one of the body components of the packer heretofore described. Preferably, as shown in FIG. 1B and enlarged scale view FIG. 6, long string mandrel LM is detachably secured to the hydraulic housing 10 by a C-ring 11 which is mounted in a counter bore 2c formed in the upper end of the mandrel bore 2a traversing the hydraulic housing 10. The C-ring 11 is provided with a plurality of vertically spaced, horizontal, internal teeth 11a which cooperate with similar axially extending external teeth 3a formed on the periphery of the long string mandrel LM. Thus, the long string mandrel LM is secured to the hydraulic housing 10 against axial movement, but is free to rotate relative to such housing, hence relative to the packer 1, in order to operate any other well tools connected to the long string mandrel LM which require rotation of the tubing string.

The locking C-ring 11 performs an additional function in permitting an adjustment of the exact axial position of the long string mandrel LM with respect to the other body components of the assembled packer. In this manner, axial position variations due to manufacturing and assembly tolerances may be compensated for by positioning the locking C-ring 11 at a selected position along the length of the mandrel threads 3a. It should be noted, however, that the connection of the long string mandrel LM to the hydraulic housing 10 is effective only so long as the hydraulic housing 10 remains in its run-in position illustrated in FIGS. 1A, 1B and 1C. When such hydraulic housing 10 shifts downwardly, in a manner to be hereinafter described, the restraint on the internally threaded C-ring 11 is removed (FIG. 3C) and relative movement of the packer body components with respect to the long string mandrel LM can occur.

Figure 7:
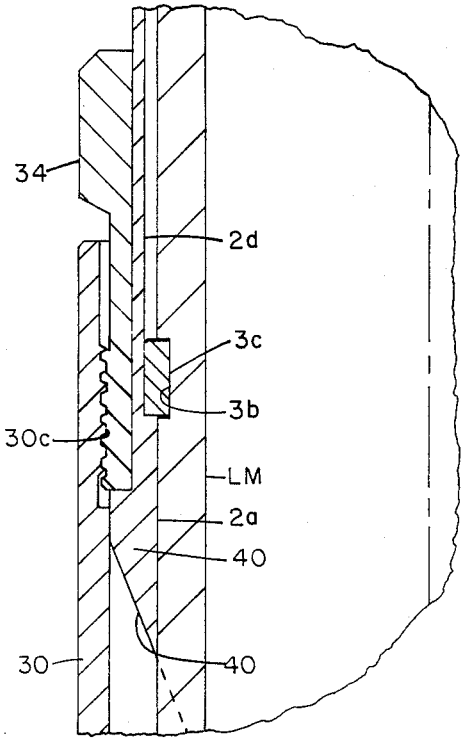
FIG. 7 is an enlarged scale view of a portion of FIG. 1B.

An abuttable engagement of the long string mandrel LM to the axially stacked body elements of packer 1 is provided comprising a C-ring 3c (FIGS. 1B and 7) mounted in an annular groove 3b provided on the exterior of the long string mandrel LM at a position adjacent to the bottom end of a counter bore 2d provided in that portion of the mandrel bore 2a which traverses the upper cone element 40. The abutment C-ring 3c not only prevents upward movement of the upper cone element 40 relative to the long string mandrel LM, but, during the unsetting of the packer by upward movement of the long string mandrel LM, the abutment C-ring 3c engages the bottom face of the lower force transmitting element 44 and moves such element upwardly to permit upward movement of the upper cone element 40 to rerelease the slips.

Figure 8:
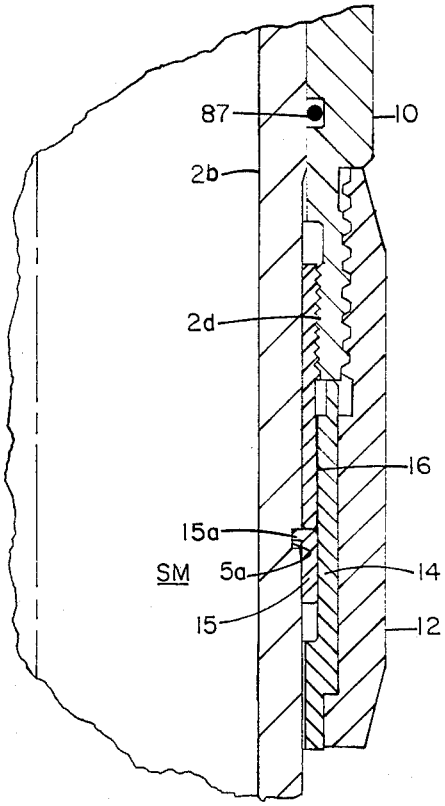
FIG. 8 is an enlarged scale view of a portion of FIG. 1C.

Additionally, the long string mandrel LM is provided with two vertically spaced external shoulders 3d and 3e, (FIG. 1A) both of which are located within a counter bore 2e formed in that portion of the mandrel bore 2a which traverses the receptacle 70. These shoulders are employed for releasing the packer by upward motion of the long string mandrel LM in a manner that will be hereinafter described. The uppermost shoulder 3*d* engages a downwardly facing shoulder 8O*c* provided on the retainer 80, while the lower shoulder 3*e* engages the shoulder 2*f* in receptacle housing 70 formed at the upper end of the counter bore 2*e*. An O-ring 83*d* mounted in retainer plate 80 sealingly engages the exterior of long string mandrel LM. If desired, an O-ring 84 may be provided between hydraulic housing bore 2*a* and the long string mandrel LM (FIG. 8).

In the run-in position of the packer 1, the short string mandrel SM is inserted through the aligned bores 2*b* in the various body components and is initially secured to such body components by three connections preventing axial movement of the short string mandrel SM relative to the particular body component, but permitting unrestricted rotation of the short string mandrel SM with respect to the body component.

The first such connection is within the gauge ring 12 which is in turn threadably secured to the hydraulic body 10. As best shown in FIGS. 1C and 8, gauge ring 12 overlies mandrel locking block 14 having mandrel apertures 2*a* and 2*b*. A spacer sleeve 16 is mounted in a threaded counter bore 2*d* provided in that portion of mandrel bore 2*b* that traverses the hydraulic housing 10. Spacer sleeve 16 is backed out of threads 2*d* to abut a lock ring 15 having an internal projection 15*a* engaging an annular groove 5*a* in short string mandrel SM. Thus, the short string mandrel SM is effectively secured against relative axial movement with respect to the hydraulic housing 10.

The second connection of the short string mandrel SM to the packer body elements is made to the receptacle 70. The lower end of the bore 2*b* extending through receptacle 70 is counterbored as indicated at 2*h* (FIG. 1A) and a annular groove 5*b* is formed in the short string mandrel SM immediately opposite the counterbore 2*h*. A C-ring 5*c* is engaged in this space to firmly secure the short string mandrel SM to receptacle 70 against axial displacement,. yet permit free rotational movement of the short string mandrel SM.

Figure 6:
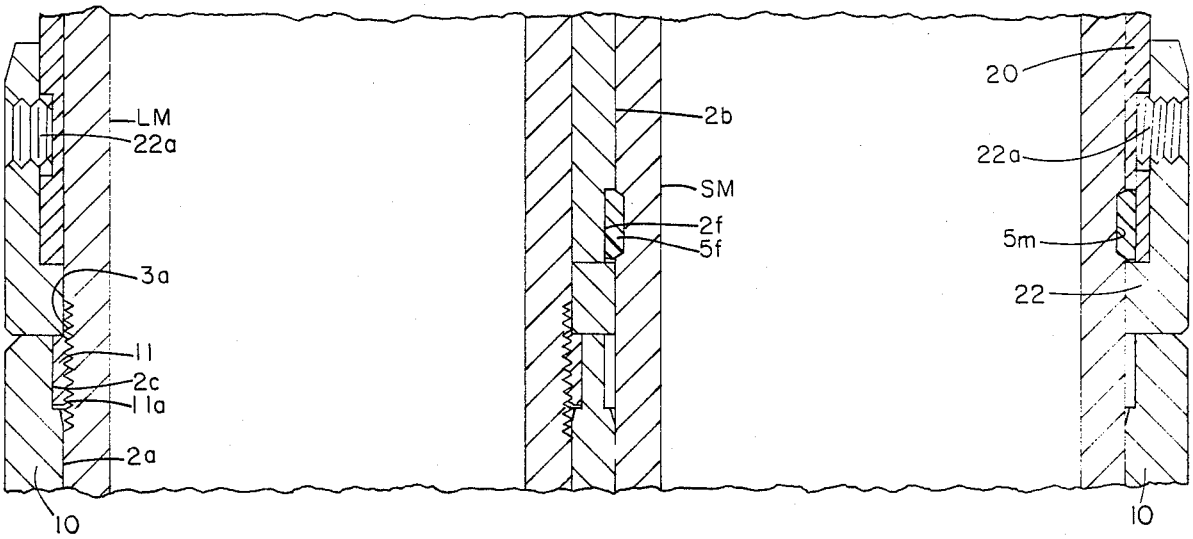
FIG. 6 is an enlarged scale view of a portion of FIG. 1B.

The third connection of the short string mandrel SM to the packer body elements is a releasable connection to the lower cone element 20 (FIG. 6). A counterbore 2*f* is formed in the bottom end portion of the mandrel bore 2*b* which extends through the lower cone element 20. Such counter bore is disposed immediately adjacent to an annular recess 5*m* formed on the periphery of the short string mandrel SM and a C-ring 5*f* is inserted in such annular groove. Obviously, upward movement of the lower cone element 20 with respect to the short string mandrel SM will remove the restraint on C-ring 5*f* and hence effect a disconnection of the short string mandrel SM from the lower cone element 20. Such upward movement of the lower cone element 20 relative to the short string mandrel SM is produced by hydraulic actuation in a manner to be hereinafter described.

The setting movement of the packer is produced by a fluid pressure activated mechanism disposed within the hydraulic housing 10. Within each of the open-top, cylinder bores 10*a* and 10*b*, a cup-shaped piston 25 (FIG. 2C) is inserted in slidable and sealable relationship. The pistons 25 are inserted in the bores 1O*a* and 1O*b* with their closed bottom portions 25*a* disposed in the downward position and such bottom portions 25*a* respectively abut internal shoulders 1O*c* and 1O*d* provided in the cylinder bores 1O*a* and 1O*b*. The remaining portions of the cylinder bores disposed below the lowermost position of the pistons 25 define fluid pressure chambers 1O*f* which are supplied with fluid by conduits 1O*e* formed in the hydraulic housing 10 and communicating with an annular recess 1O*h* (FIG. 3B) formed in the wall of bore 2*b* around a plurality of peripherally spaced radial ports 5*g* formed in the wall of short string mandrel SM. O-rings 86 and 87 seal the ends of annular recess 10*h*.

A removable plug P of conventional construction is inserted in the bore of the short string mandrel SM at a location below the ports 5*g* and fluid pressure can thus be supplied from the surface through the short string mandrel SM to the bottom end portions 1O*f* of the cylinder bores 1O*a* and 10*b*. Such pressure exerts a downward force on the hydraulic housing 10 and drives the pistons 25 upwardly so that their top open ends 25*b* engage the bottom face 20*d* of the lower cone element 20 and exert an upward force on such lower cone element. In this manner, sufficient force is exerted on the lower cone element 20 to effect a shearing of the shear pins 22*a* to permit the lower cone element 20 to move upwardly, thus releasing the C-ring 5*f* from engagement with the short string mandrel SM and permitting the short string mandrel SM to move downwardly, along with the hydraulic housing 10.

From the foregoing description, it will be readily apparent that a substantial hydraulic downward force is exerted on the short string mandrel SM since it is subject to the combined fluid pressure forces exerted in the two cylinder bores 10*a* and 10*b* and also to the fluid pressure force exerted upon the removable plug P. Thus, concurrently with the upward movement of the lower cone element 20, the receptacle 70 is pulled downwardly by virtue of its previously described connection to the short string mandrel SM and the result is that the upper and lower cone elements 20 and 40 are moved towards each other to radially expand the slips 35 into biting engagement with the well conduit wall. Contemporaneously, the downward force exerted by the receptacle 70 applies a compressive force to the three elastomeric seal elements 50, 52 and 54, resulting in their radial expansion into sealing engagement with the wall of the well conduit within which the packer is disposed. Thus, the setting of the packer is conveniently and efficiently accomplished.

To maintain the compressive forces on the lower and upper cone elements 20 and 40 and on the elastomeric packing elements 50, 52 and 54, the packer embodying this invention employs one or more locking rods 4*a* and 4*b* which are detachably connected at their upper ends to the retainer plate 80 by split bushings 7, and abuttingly connected by C-ring 4*f* (FIG. 2A) to the receptacle housing 70 for co-movement in the downward direction. At their lower ends, rods 4 are effectively in abutting relationship to the bottom surface 20*d* of the lower cone element 20 by a unidirectional ratcheting mechanism.

Figure 10:
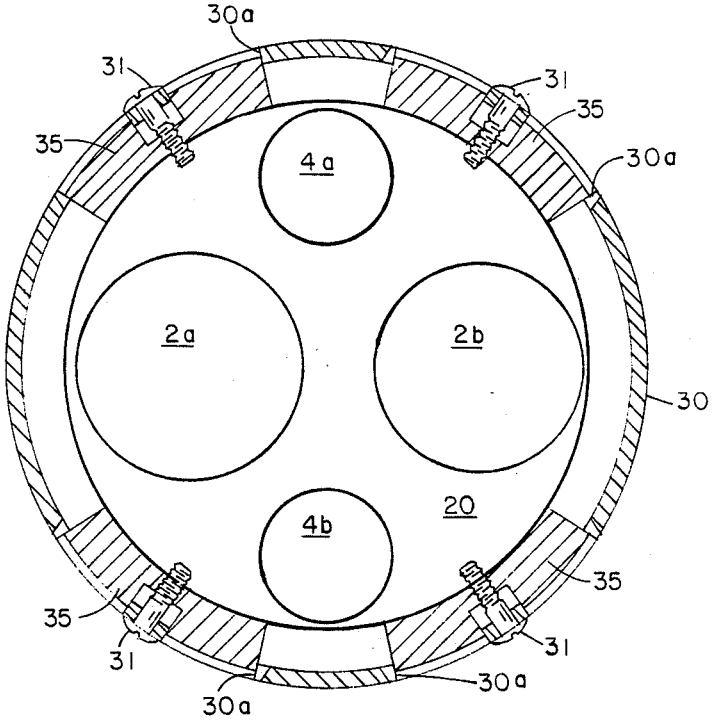
FIG. 10 is a sectional view taken on the plane 10—10 of FIG. 1B.
Figure 9:
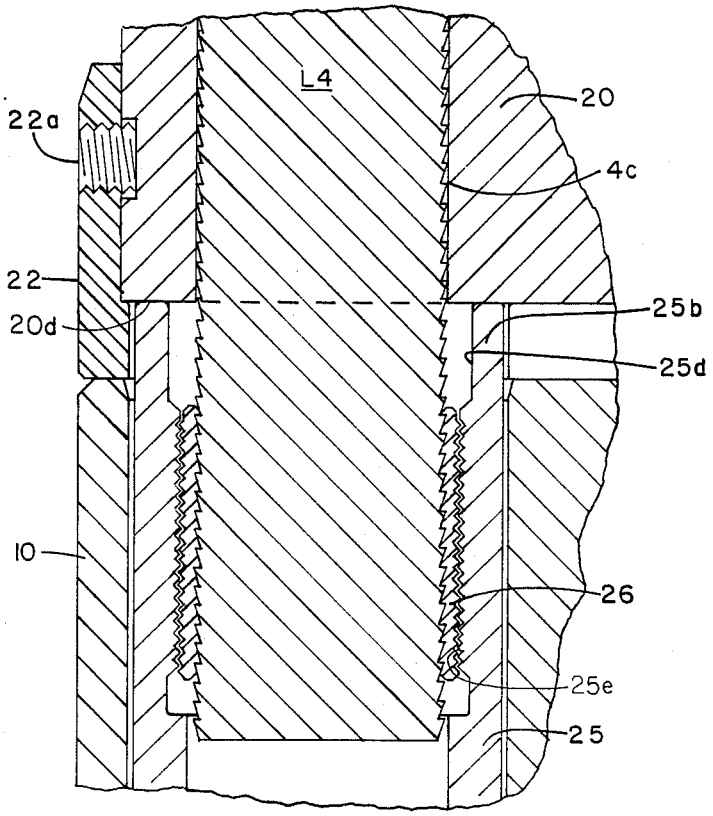
FIG. 9 is an enlarged scale view of a portion of FIG. 2C.

As best shown in FIG. 10, the unidirectional ratcheting mechanism comprises wicker threads 4*c* formed on the bottom ends of the locking rods 4 and extending axially for a distance equivalent to the maximum downward travel distance of the locking rods 4. The open upper ends of pistons 25 are counterbored as indicated at 25*d* (FIG. 9) and within such counterbore, a body lock ring 26 is mounted in conventional fashion on internal threads 25*e* to provide a unidirectional ratcheting connection between the wicker threads 4*c* on the locking rods 4 and the top ends of the pistons 25. Since the pistons 25 are in abutting engagement with the bottom surface 20*d* of the lower cone element 20, the connection effectively is between the locking rods 4 and the lower cone element. Thus, as the setting of the packer progresses and the locking rods 4 move downwardly they are restrained against upward return movement by the body lock rings 26 and the packer is effectively locked in its set position.

The top ends of the locking rods 4 are detachably secured to the retainer 80. Such top ends are provided with external threads 4*e* which may have a zero pitch. These threads are engaged by the split, internally threaded, cup-shaped bushing 7 which is mounted within the downwardly opening bores 8O*a* and 80*b* formed in the retainer 80, but retained against downward movement by abutment with the top surface of receptacle 70. Thus, as long as the retainer plate 80 is secured in abutting relationship to the top of the receptacle 70 by the shear screws 81, the locking rods 4 are rigidly secured to such retainer. If an upward force is applied to the retainer plate 80 relative to the receptacle 70, the shear screws 81 can be sheared to permit the retainer plate 80 to move upwardly and such upward movement will effect the release of the axially split bushings 7 from the threaded ends of the locking rods 4, thus releasing all tension on such rods and removing the compressive forces from the body elements of the packer.

One additional connection is provided between the locking rods 4 and the axially stacked body elements of the packer 1. C-rings 4*g* are provided in an annular groove 4*h* formed in the exterior of a lower portion of the locking rods 4. The C-rings 4*g* can move downwardly with the locking rods 4 in a counter bore 4*m* and 4*n* provided in the top portion of the bores 4*a* and 4*b* provided in the upper cone element 40. Such locking C-rings 4*g* do not prevent downward movement of the locking rods 4 but prevent downward movement of the upper cone element 40 relative to locking rods 4.

Locking C-ring 4*g* is employed to prevent any accidental presetting of the packer should it be necessary to pull the packer up the well hole and the packer body elements become wedged or go through a tight spot so as to impose a downward force on the upper cone element 40. The locking C-ring 4*g* effectively prevents any relative downward movement of the upper body components of the packer relative to the locking rods 4.

The setting operation of the packer has been covered in the foregoing description. The removable plug P is removed and all fluid pressure is relieved from chambers 10*f*. To unset the packer, an upward force is applied to the long tubing mandrel LM. The first consequence of such upward force is to shear bolts 22 to release the long tubing string LM from hydraulic housing 10. Further upward movement brings the shoulder 3*d* (FIG. 1) on the long string mandrel LM into engagement with the downwardly facing shoulder 80*c* on the retainer plate 80. The application of an upward force to the retainer plate 80 effects the shearing of shear pins 81 and hence permits the retainer plate 80 to move upwardly relative to the receptacle 70 and thus release the axially split locking bushings 7 from the top threaded ends of the locking rods 4. This removes all tension on the locking rods 4 and permits the compressed elements of the packer to relax. Further upward movement of the long string mandrel LM brings the upwardly facing shoulder 3*e* into engagement with the downwardly facing shoulder 2*f* provided in the receptacle 70 and moves the receptacle 70 upwardly which, of course, moves the short string mandrel SM and the interconnected hydraulic cylinder 10 and all intermediate elements upwardly. Additionally, such further upward travel of the long string mandrel LM brings the abutment C-ring 3*c* on the mandrel into engagement with the downwardly facing shoulder 44*c* provided on the lower force transmitting block 44 and this, of course, applies an upward force to the upper cone element 40 to positively release the slips 35.

A packer embodying this invention may incorporate several additional desirable features. For example, in the event that release of the packer by upward movement of the long string mandrel LM is not possible, for whatever reason, the release of the packer may be accomplished by milling off the top portions of both mandrels and the retainer plate 80, thus releasing locking rods 4. A wireline fishing tool can then be lowered into the bore of either the long string mandrel LM or short string mandrel SM. The removal by the long string mandrel has already been described. If the short string mandrel SM is engaged, the retrieval is accomplished by an abutment C-ring 3*m* mounted in an annular groove 3*n* provided on the exterior of the short string mandrel SM and lying within a counter bore 2*m* formed in the bore 2*b* which traverses the upper cone element 40 (FIG. 1A). Such upward movement of short string mandrel SM will bring the abutment C-ring 3*m* into engagement with the lower force transmitting block 44 and exert an upward force on the upper cone element 40 to positively release the slips 35 and retrieve the packer body elements from the well.

Another safety feature may be conveniently incorporated in a packer embodying this invention. Such feature comprises a shock absorbing assemblage 90 shearably mounted on the long string mandrel LM at a substantial distance below the bottom end of the axially stacked body elements of the packer (FIG. 1C). Shock absorber 90 comprises a shear ring 91 having a radial annular projection 91*a* engaging a correspondingly shaped groove 3*p* provided in the external surface of the long string mandrel LM. Shear ring 91 is in turn overlapped by an annular shear ring cage 92. Bolts 93 are threaded through the shear ring cage 92 into engagement with the surface of the long string mandrel LM so that the assemblage is secured to the mandrel. A shock absorber case 94 is mounted in surrounding relationship to the shear ring cage 92 and is provided with axially extending slots (not shown) which surround the heads of the bolts 93. The upper end of the shock absorbing case 94 has a radially inwardly projecting portion 94*a* which abuts the top end of an annular elastomeric shock absorber 95. Thus, in the event the long string mandrel LM moves rapidly upwardly relative to the packer, due to fluid pressure forces or relaxation of tensile forces on the long tubing string connected to the long string mandrel LM, the shock absorber case 94 will contact the bottom end of the lowermost gauge ring 12 and prevent excess upward travel of the long string mandrel LM while cushioning any impact forces by compression of the elastomeric shock absorber.

Upward movement of the long string mandrel LM for removal purposes brings case 94 into engagement with the bottom of hydraulic housing 10 and shears shear ring 91.

It will also be readily apparent to those skilled in the art that the aforedescribed construction is not necessarily limited to use with two mandrels or with two force transmitting rods. The embodiment of the invention heretofore described represents a preferred embodiment, but it is quite possible to have an effective packer with the body elements of the packer mounted on a single mandrel which of cours would be the equivalent of the short string mandrel SM previously described. It is of course necessary that an expansion joint be incorporated in the tubing string to permit the required downward movement of the short string mandrel SM under the packer setting fluid pressure forces.

Similarly, the employment of two locking rods merely represents a preferred embodiment. The body elements of the packer can be effectively locked through the utilization of a single locking rod.

In summary, the method of the invention may be described as forming an axially stacked assembly of radially expandable slip elements and one or more radially expandable packing elements upon a mandrel, with the assembly including upper and lower cone elements for expanding slips into engagement with the wall of the well conduit and expander elements for expanding the radially expandable packing elements, a hydraulic cylinder housing at the bottom of the assemblage, a receptacle housing at the top of the assemblage and a retainer plate shearably secured to the top of the receptacle and detachably secured to one or more locking rods extending downwardly through the assemblage and having a unidirectional ratcheting connection with the lower cone element. The packer is set through the application of a hydraulic force between the hydraulic housing and the lower cone element, which is transmitted by the mandrel to the receptacle housing to effect the compression of the expandable packing element(s) and the relative movement of the upper and lower cone elements to expand the slips. The unidirectional ratcheting connection between the bottom ends of the locking rods and the lower cone element retains the body elements of the packer in their compressed and set positions. Upward movement of another mandrel will effect the release of the retainer plate from the top ends of the locking rods and hence the release of compressive forces on the expanded elements of the packer.

The packer embodying this invention is unique in the mechanism for effecting the release of compressive forces on the expandable elements of the packer is located entirely at the top end of the packer. Thus, in the event of a complete failure of the packer to unset by upward manipulation of either the long string mandrel or the short string mandrel, the packer may still be effectively removed from the well by milling off the retainer plate 80, thus releasing the forces on the locking rods and exposing the mandrel receiving bores. Either of such bores may then be conveniently engaged by a wireline tool to effect the retrieval of the remaining components of the packer from the well.

Figure 11A:
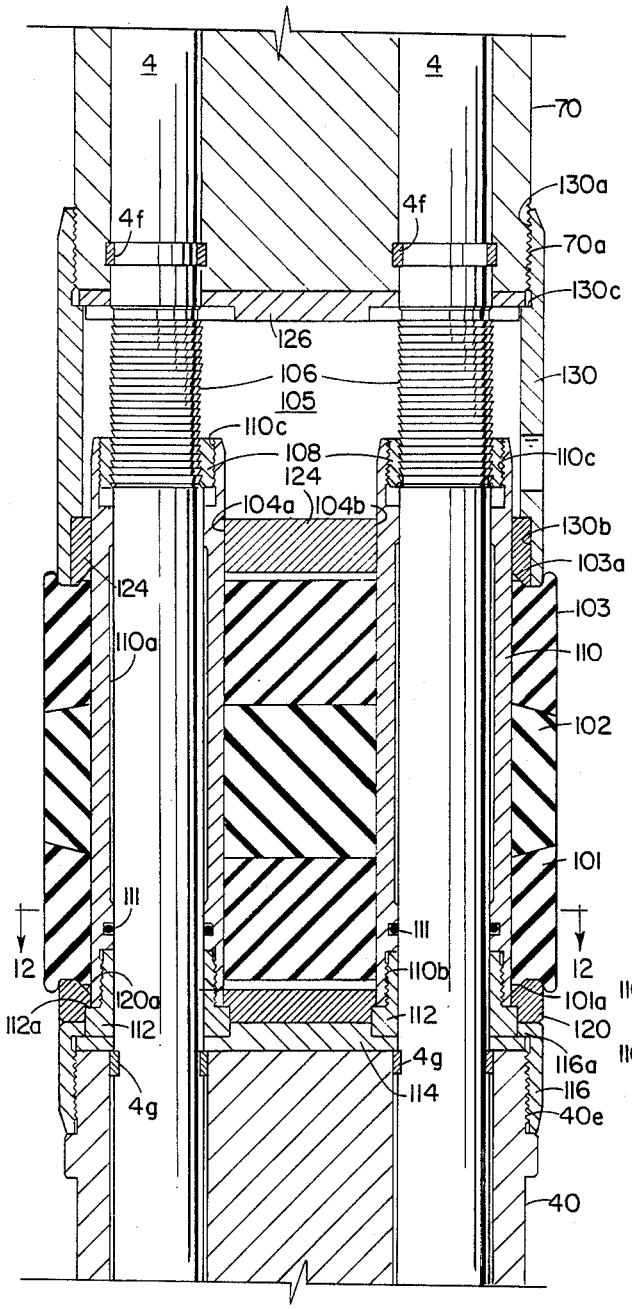
FIG. 11A is a longitudinal sectional view of a modification of this invention incorporating a booster piston sleeve around the upper ends of each of the locking rods to impart an additional upwardly directed compressive force to the expandable packing elements; the modified components are shown in their initially expanded position.
Figure 11B:
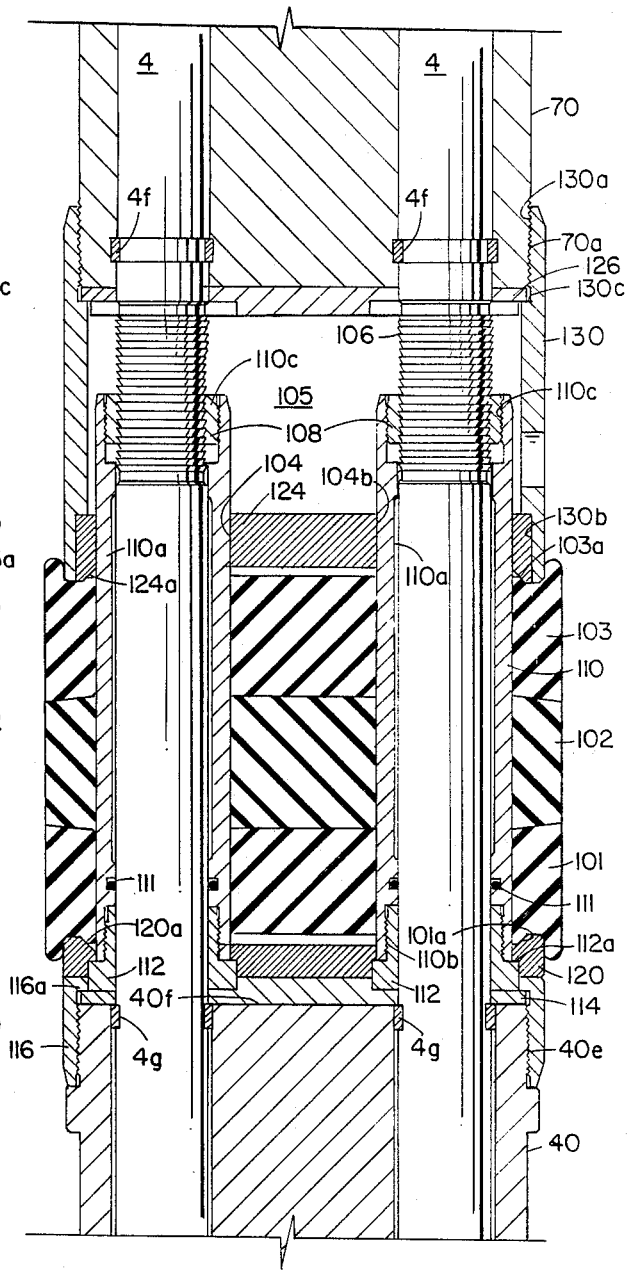
FIG. 11B is a view similar to FIG. 11A but showing the position of the modified components upon the occurrence of a well annulus pressure below the expanded packing elements in excess of the annulus pressure above the expanded packing elements.
Figure 12:
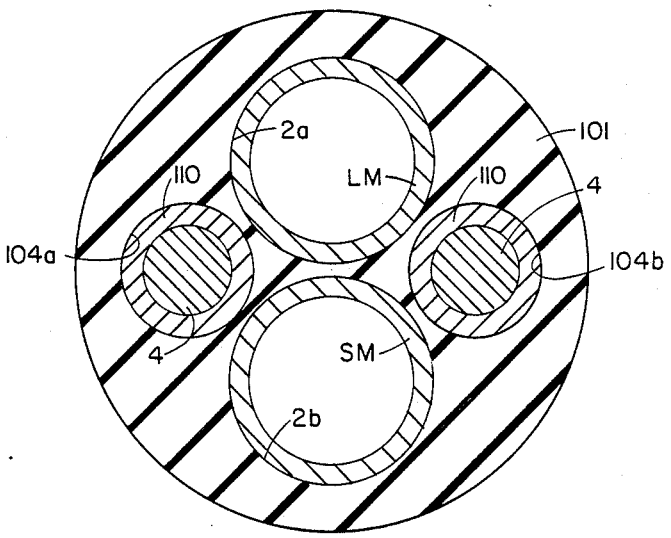
FIG. 12 is a sectional view taken of the plane 12—12 of FIG. 11A.

Referring now to FIGS. 11A, 11B and 12 there is shown a preferred embodiment of this invention wherein an additional compressive force is imparted to the expandable packing elements upon the occurrence of a well annulus pressure below the expanded packing element in excess of the well annulus pressure above the expanded packing element. Similar numbers refer to elements which have already been described. Thus, the expandable packing elements now comprise three generally cylindrical elastomeric elements 101, 102 and 103 which are disposed in vertically stacked relationship between the upper end of the upper cone element 40 and the lower end of the receptacle 70 previously described. Packing elements 101, 102 and 103 are each provided with aligned bore holes **2*a* and 2*b* (FIG. 12) and aligned locking rod holes 1O4*a* and 104*b* which are, however, of substantially greater diameter than the diameter of the locking rods 4** which traverse such holes.

In the annulus thus defined between the exterior of the locking rods 4 and the bores **104*a* and 104*b*, a pair of identical piston sleeves 110 are respectively mounted. The exterior of each of the sleeves 110 is sealably engaged with the interior surface of bores 104*a* and 1O4*b* respectively. The interior bore of sleeves 110 are sealingly engaged with the exterior of locking rods 4 by O-ring seals 111. Intermediate the bottom end portion of piston sleeves 110 containing the O-rings 111 and the upper end portion of such sleeves, the sleeve bore is recessed as indicated at 110*a* to more readily permit slidable movement of the piston sleeves 110 with respect to the locking rods 4**.

The lower end of each piston sleeve 110 is provided with internal threads **110*b* and such threads are in turn engaged by a booster sleeve retainer 112. The booster sleeve retainer is in turn abutted by an insert ring 114 which is disposed between the bottom end of retainer 112 and the top end surface 40*f* of the upper cone 40. Insert ring 114 is retained in position by an internally projecting flange 116*a* provided on a gauge ring 116 which is threadably secured to the external threads 40*e* provided on the upper end of the upper cone element 40**.

Sleeve retainer 112 has a radially outwardly projecting shoulder **112*a* which effects an abutting engagement with a force transmitting expander 120 which is a disc shaped member traversed by the mandrel bores 2*a* and 2*b* and locking rod bores 4*a* and 4*b*. The top face of expander or force transmitting element 120 has an inclined portion 120*a* which is engagable with a similar downwardly facing inclined portion 101*a* formed on the lowermost one of the vertically stacked elastomeric seal members 101, 102 and 103**.

At its upper end, each piston sleeve 110 traverses a bore **104*a* or 104*b*, as the case may be, provided in an upper force transmitting or expander element 124. Upper expander element 124 is additionally provided with bores 2*a* and 2*b* (not shown) respectively alignable with the similarly numbered bores in the other axially stacked body elements of the packer. An axial space 105 is provided between the top end of the piston sleeve 110 and the lower end of the receptacle 70. That portion of the locking rods 4 traversing the space 105 is provided with unidirectional ratchet or wicker threads 106. Wicker threads 106 are in turn cooperative with a conventional body lock ring 108 which is mounted within internal threads 110*c* provided in the extreme upper end of piston sleeve 110**.

The axial space 105 is provided by an axially extended gauge ring 130 which is provided with internal threads **130*a* at its upper end to cooperate with the external threads 70*a* provided on the bottom of the receptacle 70. The lower end of gauge ring 130 is counterbored as at 130*b* to accommodate the upper force transmitting or expander member 124. The expander member has a downwardly facing inclined surface 124*a* which cooperates with a similarly inclined upper face 103*a* of the uppermost elastomeric sealing element 103. Lastly, a generally cylindrical spacer element 126 is mounted intermediate the bottom end face of receptacle 70 and the upwardly facing surface 130c which is provided at the lower end of the threads 130a. Spacer element 126 is, of course, provided with mandrel bores 2a and 2b (not shown) and rod bores 4a and 4b**.

In FIG. 11a, the packing elements 101, 102 and 103 are shown in their positions occupied during the initial setting of the packer produced by the concurrent downward movement of the receptacle 70 and the upward movement of the lower cone 20 produced by the pistons 25 in the manner heretofore described. Once the packer has been set, it is possible for the well annulus pressure below the set packer, hence below the expanded sealing elements 101, 102 and 103, to exceed the fluid pressure in the well annulus above such expanded sealing elements. Under such conditions, the excess fluid pressure force is applied to the piston sleeve 110 and such sleeve is forced upwardly to the position illustrated in FIG. 11B. Thus, an additional compressive force is imparted to the expanded sealing elements 101, 102 and 103 to further insure the integrity of the seal of these elements against the casing or well bore.

Such additional compressive force is trapped within the sealing elements 101, IO2 and 103 by the unidirectional ratcheting action of the body lock ring 108 with respect to the ratchet threads 106. Thus, it is assured that any increase in fluid pressure below the set packer will have no adverse effect upon its sealing integrity but will increase the amount of compressive force upon the sealing elements 101, 102 and 103.

Those skilled in the art will understand that the representation of the sealing structure as comprising three separate sealing elements is merely an exemplary representation. The packer will be effective with a single sealing element or with any number of axially stacked sealing elements. Moreover, such sealing elements may be separated by metallic spacer elements such as the elements 60 and 62 as shown in the modification of FIGS. 1–10. Accordingly, the term "elastomeric sealing element" or "elastomeric packing element" employed in the claims is intended to include a single sealing element or a plurality of axially stacked sealing elements separated by appropriate spacers, if desired. It will also be apparent to those skilled in the art that the aforedescribed modifications of the invention may be utilized for a packer accommodating more than two tubing strings. For example, three or four mandrel receiving bores may be provided in peripherally spaced relationship about the axis of the axially stacked body elements of the packer and a single locking rod employed which is coaxially disposed relative to the body elements. The described modification merely represents a convenient arrangement for a dual string packer which will accommodate two tubing strings of the diameters normally employed in the size of well bore illustrated in the drawings.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of th described invention.

What is claimed and desired to be secured by Letters Patent is:

1. A dual string packer for subterranean wells comprising a plurality of vertically stacked cylindrical elements comprising from the bottom up: a hydraulic housing element; a lower cone element; an annular slip cage element; an upper cone element; a first expander element; an elastomeric packing element; a second expander element, and a receptacle housing element; all of said elements being disposed in axially stacked, abutting relationship; a plurality of slips radially shiftably mounted in said slip cage element in peripherally spaced relation; all of said elements except said annular slip cage element having a first pair of axially extending parallel bores therethrough; a pair of mandrels respectively rotatably and slidably mounted in said first pair of bores; means for securing one of said mandrels to said receptacle housing to prevent axial displacement relative thereto; means for securing said one mandrel to said hydraulic housing element to prevent axial displacement relative thereto, thereby securing all of said elements in said axially stacked relationship; means for securing said other mandrel to at least one of said axially stacked elements, whereby said axially stacked elements may be run into a well on a tubing string secured to said other mandrel; all of said axially stacked elements except said annular slip cage and said hydraulic housing element having a second pair of parallel bores extending therethrough; a pair of continuous locking rods respectively slidably mounted in said second pair of bores; locking means detachably secured to the top ends of said rods and abutting the top of said receptacle housing element to prevent downward movement of said rods relative to said receptacle housing; abutment means in said receptacle housing for moving said locking rods downwardly with said receptacle housing; said hydraulic housing element having two closed end cylinder ores into which the bottom ends of said locking rods respectively project; a pair of hollow pistons having open and closed end portions, said closed end portions cooperating with said cylinder bores and said open end portions being abuttable with the bottom end of said lower cone housing element and receiving the bottom ends of said locking rods in telescopic relation; axially extending wicker threads on each bottom end of said rods; a body lock ring mounted intermediate each piston and the adjacent wicker threads; thereby permitting downward movement of said rods relative to said pistons but preventing upward relative movement; and means for supplying pressured fluid to said cylinder bores below said pistons, thereby applying an upward force to said lower cone housing element and downward force to said receptacle housing through said hydraulic housing element and said one mandrel to set the packer by expanding said slip elements and said elastomeric packing element.

2. The apparatus of claim 1, wherein said means for supplying pressured fluid to said cylinders bores comprises removable plug means for sealing the bore of said one mandrel; and means including an adjustable length conduit for supplying pressured fluid to the bore of said one mandrel, thereby supplementing the downward force exerted on said one mandrel by said hydraulic housing element.

3. The apparatus of claim 2, further comprising port means in said one mandrel and said hydraulic housing element for supplying pressured fluid to said cylinder bores.

4. The apparatus of claim 1, further comprising: a shearable connection between said lower cone housing element and said one mandrel to prevent relative movement of said elements during run-in; said shearable connection being disconnected by initial upward movement of said lower cone housing element produced by said pistons.

5. The apparatus of claim 1, wherein said means for connecting said other mandrel to at least one of said axially stacked elements comprises: a set of axially extending zero pitch threads on the exterior of said other mandrel; a C-ring having internal zero pitch threads engagable with said zero pitch threads on said other mandrel at a selected axial position; said hydraulic housing element having a counterbore in the upper end of said bore receiving said C-ring therein to maintain locking engagement between said other mandrel and said hydraulic housing element until said hydraulic housing element is shifted downwardly by said pressured fluid.

6. The apparatus of claim 1 further comprising: a shoulder on said other mandrel engagable by upward movement of said other mandrel with said receptacle housing to release said detachable locking means, thereby releasing the setting force on said locking rods to release the packer.

7. The apparatus of claim 6, further comprising: a fixed abutment on the exterior of said other mandrel spaced above said shoulder; said upper cone housing element bore receiving said other mandrel having a downwardly facing shoulder engagable by said fixed abutment to elevate said upper cone housing element to release said slip elements and permit removal of the packer from the well.

8. The apparatus of claim 7, further comprising: a fixed abutment ring on the exterior of said one mandrel engagable with said upper cone element by upward movement of said one mandrel to unset the packer in the event release cannot be effected by upward movement of said other mandrel.

9. The apparatus of claim 1, wherein said detachable locking means comprises: external threads on the top ends of said locking rods; a retainer body abutting the top of said receptacle and apertured to receive both of said mandrels therethrough; said retainer body having downwardly open bores to receive said threaded ends therein; an axially split, internally threaded bushing mounted in each said bore and respectively engagable with said external threads to prevent downward axial movement of said rods relative to said receptacle housing; shearable means securing said retainer body to said receptacle housing; and an abutment on one of said mandrels engagable with said retainer body whereby an upward force on said mandrel having said abutment shears said shearable means and releases the top ends of said locking rods from said body, thereby unsetting the packer.

10. A dual string packer for subterranean wells comprising a plurality of vertically stacked cylindrical elements comprising from the bottom up: a hydraulic housing element; a lower cone element; an annular slip cage element; an upper cone element, a first expander element, an elastomeric packing element; a second expander element, and a receptacle housing element, all of said elements being disposed in axially stacked abutting relationship; a plurality of slips radially shiftably mounted in said cage in peripherally spaced relation; all of said elements except said annular slip cage element having a first pair of axially extending parallel bores therethrough; a pair of mandrels respectively rotatably and slidably mounted in said first pair of bores; means for securing one of said mandrels to said receptacle housing to prevent axial displacement relative thereto; means for securing said one mandrel to said hydraulic housing element to prevent axial displacement relative thereto; thereby securing all of said elements in said axially stacked relationship; means for securing said other mandrel to at least one of said axially stacked elements, whereby said axially stacked elements may be run into a well on a tubing string secured to said other mandrel; all of said axially stacked elements except said annular slip cage and said hydraulic housing element having a second pair of parallel bores extending therethrough; a pair of continuous locking rods respectively slidably mounted in said second pair of bores; locking means detachably secured to the top ends of said rods and abutting the top of said receptacle housing element; fluid pressure responsive means in said hydraulic housing element for moving said hydraulic housing element, said one mandrel, said receptacle housing and said rods downwardly relative to said lower cone element to set the packer; and unidirectional ratchet means operatively connecting the bottom ends of said rods to said lower cone element to secure said rods in said packer setting position.

11. The apparatus of claim 10, wherein said unidirectional ratchet means comprises: wicker threads on the bottom ends of said locking rods; a tubular element surrounding said bottom ends of said rods and abuttable with the bottom of said lower cone element; and a body lock ring operatively connected between said tubular element and said threaded bottom ends of said rods.

12. The apparatus of claim 10, wherein said locking means comprises: external threads on the top ends of said locking rods; a retainer body abutting the top end of said receptacle and apertured to receive both of said mandrels therethrough; said retainer body havfng downwardly open bores receiving said threaded rod ends therein; an axially split internally threaded bushing mounted in each said bore and respectively engagable with said external threads to prevent downward axial movement of said rods relative to said receptacle; shearable means securing said retainer body to said receptacle housing; and an abutment on one of said mandrels engagable with said retainer body, whereby an upward force on said mandrel having said abutment shears said shearable means and releases the top ends of said locking rods from said receptacle, thereby unsetting the packer.

13. A dual string packer for subterranean wells comprising a plurality of vertically stacked cylindrical elements comprising from the bottom up: a hydraulic housing element; a lower cone element; an annular slip cage element; an upper cone element, a first expander element, an elastomeric packing element, a second expander element, and a receptacle housing element, all of said elements being disposed in axially stacked, abutting relationship; a plurality of slips radially shiftably mounted in said cage in peripherally spaced relation; all of said elements except said annular slip cage element having a first pair of axially extending parallel bores therethrough; a pair of mandrels respectively rotatably and slidably mounted in said first pair of bores; means for securing one of said mandrels to said receptacle housing to prevent axial displacement relative thereto; means for securing said one mandrel to said hydraulic housing element to prevent axial displacement relative thereto; thereby securing all of said elements in said axially stacked relationship; means for securing said other mandrel to at least one of said axially stacked elements, whereby said axially stacked elements may be run into a well on a tubing string secured to said other mandrel; all of said axially stacked elements except said annular slip cage and said hydraulic housing element having a second pair of parallel bores extending therethrough; a pair of continuous locking rods respectively slidably mounted in said second pair of bores; locking means detachably secured to the top ends of said rods and abutting the top of said receptacle housing element; said hydraulic housing element having two closed end cylinder bores into which the bottom ends of said locking rods respectively project; piston means in said cylinder bores movable upwardly to abut said lower cone element; and means for supplying pressured fluid to said cylinder bores below said pistons, whereby said hydraulic housing element, said one mandrel, and said receptacle are moved downwardly and said lower cone element is moved upwardly to expand said elastomeric packing element and said slip elements to set the packer.

14. The apparatus of claim 13, further comprising unidirectional ratchet means operable between said rods and said lower cone element to secure all said elements in said set position.

15. The apparatus of claim 13, wherein said unidirectional ratchet means comprises: upwardly open bores in said pistons respectively surrounding said bottom ends of said rods and abuttable with the bottom of said lower cone element; and a body lock ring operatively connected between said each of said pistons and said bottom ends of said rods.

16. The apparatus of claim 14, wherein said locking means comprises: external threads on the top ends of said locking rods; a retainer body abutting the top of said receptacle housing and apertured to receive both of said mandrels therethrough; said retainer body having downwardly open bores receiving said threaded rod ends therein; an axially split internally threaded bushing mounted in each said bore and respectively engagable with said external threads and abutting said receptacle housing; shearable means securing said retainer body to said receptacle housing; and an abutment on one of said mandrels engagable with said retainer body, whereby an upward force on said mandrel having said abutment shears said shearable means and releases the top ends of said rods from said retainer body, thereby unsetting the packer.

17. The apparatus of claims 1, 10, or 13 comprising: a pair of sleeve pistons respectively surrounding the upper portions of said locking rods and sealably traversing said elastomeric sealing element; each said piston sleeve having its lower end secured to the lowermost seal expander element; means for sealing the interior surface of said piston sleeve to the exterior surface of the respective locking rod, whereby a higher annulus pressure below said elastomeric sealing element than above will produce an upward movement of said piston sleeves and lower expander elements to further compress said elastomeric sealing element; and unidirectional ratcheting locking means operable respectively between said piston sleeves and said rods to trap said piston sleeves in said upwardly moved position to trap said further compressive force in said elastomeric packing element.

18. The apparatus of claims 1, 10, or 13 comprising: a pair of sleeve pistons respectively surrounding the upper portion of said locking rods and sealably traversing said elastomeric sealing element; each said piston sleeve having its lower end secured to the lowermost seal expander element; means for sealing the interior of said piston sleeve to the exterior surface of the respective locking rod, whereby a higher annulus pressure below said elastomeric sealing element than above will produce an upward movement of said piston sleeves and lower expander elements to further compress said elastomeric sealing element; ratchet threads on the portions of said rods projectig upwardly through said piston sleeves; body lock rings respectively operatively disposed between said sleeves and said ratchet threads to permit upward movement of said sleeves and expander element relative to said rods, but preventing any return downward movement, thereby trapping an additional compressive force in said elastomeric seal element.

19. A packer for subterranean wells comprising a plurality of vertically stacked cylindrical elements comprising from the bottom up: a hydraulic housing element; a lower cone element; an annular slip cage element; an upper cone element, a first expander element, an elastomeric packing element; a second expander element, and a receptacle housing element, all of said elements being disposed in axially stacked, abutting relationship; a plurality of slips radially shiftably mounted in said cage in peripherally spaced relation; all of said elements except said annular slip cage element having a first axially extending bore therethrough; a hollow mandrel rotatably and slidably insertable in said first bore; means for securing said mandrel to said receptacle housing to prevent axial displacement relative thereto; means for securing said mandrel to said hydraulic housing element to prevent axial displacement relative thereto, thereby securing all of said elements in said axially stacked relationship; and means for setting said packer comprising a second bore extending through all of said axially stacked elements except said annular slip cage and said hydraulic housing elements; a continuous locking rod slidably mounted in said second bore; abutment means connecting said locking rod to said receptacle housing element for co-movement only in a downward direction; locking means detachably secured to the top end of said rod and abutting the top end of said receptacle housing; an axially extending closed end bore in said hydraulic housing element; a piston cooperable with said closed end bore; means for supplying pressured fluid to said closed end bore, thereby shifting said piston upwardly against said lower cone element and said hydraulic housing element downwardly with said mandrel, said receptacle housing and said rod to expand said elastomeric packing element and said slips to set said packer.

20. The apparatus of claim 19, further comprising unidirectional ratchet means operatively connected between the bottom portions of said locking rod and said lower cone element to secure the packer in said set position.

21. The apparatus of claim 18, further comprising a shearable connection between said lower cone element and said mandrel to prevent relative movement of said elements during run-in.

22. The apparatus of claim 6, wherein said locking means comprises external threads on the top end of said locking rod; a retainer plate having a downwardly open bore concentrically receiving said external threads on said top end of said rod; said retainer plate overlying said receptacle housing; an axially split, internally threaded sleeve snugly mounted in said downwardly open bore and abutting the top of said receptacle housing element; and means shearable by an upwardly directed force exerted by said mandrel for connecting said retainer plate to said receptacle housing element.

23. The apparatus of claim 19, wherein said closed end bore in said hydraulic housing element is concentrically aligned with the bottom end of said locking rod and said piston has a hollow portion concentrically receiving said bottom end of said rod.

24. The apparatus of claim 6, wherein said closed end bore in said hydraulic housing element is concentrically aligned with the bottom end of said rod and said piston has a hollow portion concentrically receiving said bottom end of said rod, and said unidirectional ratchet means comprises ratchet threads formed on said bottom end of said rod and body lock ring means operatively connected between said hollow piston portion and said ratchet threads.

25. The apparatus of claim 19, wherein said means for supplying fluid pressure to said closed end bore comprises removable plug means insertable in said mandrel and conduit means in said hydraulic housing element communicating between said closed end bore and the bore of said mandrel above said removable plug means.

26. The apparatus of claim 19, comprising: a piston sleeve surrounding the upper portion of said locking rod and sealably traversing said elastomeric sealing element; said piston sleeve having its lower end secured to the lowermost seal expander element; means for sealing the interior surface of said piston sleeve to the exterior surface of the locking rod, whereby a higher annulus pressure below said elastomeric sealing element than above will produce an upward movement of said piston sleeve and lower expander element to further compress said elastomeric sealing element; and unidirectional ratcheting locking operable respectively between said piston sleeve and said rod to trap said piston sleeve in said upwardly moved position to trap additional compressive force in said elastomeric packing element.

27. The method of setting a packer in a subterranean well, said packer comprising the following axially stacked elements from the bottom up: a hydraulic housing; a lower cone body; an annular slip cage mounting radially shiftable slips; an upper cone body; a lower expander body; a radially expansible packing body; an upper expander body; a receptacle body; and a retainer plate; each of said elements except said annular slip cage having a first set of aligned bores extending therethrough; comprising the steps of:

(1) inserting a mandrel through the first set of said aligned bores;

(2) securing said mandrel to said hydraulic housing for axial co-movement;

(3) securing said mandrel to said receptacle for axial co-movement;

(4) positioning a fluid pressure actuated piston between said hydraulic housing and said lower cone body;

(5) detachably connecting a downwardly extending rod at its upper end to said retainer plate; said rod traversing a second set of aligned bores in said receptacle housing; said upper expander body, said expandable packing body, said lower expander body, said upper cone body and said lower cone body;

(6) applying fluid pressure to said piston to thereby move said lower cone body upwardly and said hydraulic housing, said mandrel, and said receptacle body and said rod downwardly to concurrently radially expand said packing element and said slips and move said rod downwardly relative to said lower cone body; and (7) effecting a undirectional ratcheting connection between the bottom end of said rod and said lower cone body, thereby trapping the compressive setting forces in said expanded packing body and said slips.

28. The method of claim 27 further comprising: the steps of seating a plug in the mandrel bore; supplying fluid pressure to the mandrel bore through a tubing string including an expansion joint; and directing the said fluid pressure to said piston, whereby said mandrel is additionally urged downwardly by said fluid pressure acting on said plug.

29. The method of claim 27, further comprising the steps of: connecting a tubing string to said mandrel; said tubing string including an expansion joint to permit downward movement of said mandrel to set the packer.

30. The method of setting a packer in a subterranean well, said packer comprising the following axially stacked elements from the bottom up: a hydraulic housing; a lower cone body; an annular slip cage mounting radially shiftable slips; an upper cone body a lower expander body; a radially expansible packing body; an upper expander body; a receptacle body; and a retainer plate; each of said elements except said annular slip cage having a first set of aligned bores extending axiall therethrough; comprising the steps of:

(1) inserting a first mandrel through the first set of said aligned bores;

(2) securing said mandrel to said hydraulic housing for axial co-movement;

(3) securing said mandrel to said receptacle for axial co-movement;

(4) positioning a fluid pressure actuated piston between said hydraulic housing and said lower cone body;

(5) detachably connecting a downwardly extending rod at its upper end to said retainer plate; said rod traversing a second set of aligned bores in said receptacle housing; said upper expander body, said expandable packing body, said lower expander body, said upper cone body and said lower cone body;

(6) inserting a second mandrel through a third set of aligned bores in said elements and detachably connecting said second mandrel to one of said axially stacked elements to run the packer in the well;

(7) applying fluid pressure to said piston to thereby move said lower cone body upwardly and said hydraulic housing, said mandrel, and said receptacle body downwardly to concurrently radially expand said packing element and said slips and move said rod downwardly relative to said lower cone body; and (8) effecting a unidirectional ratcheting connection between the bottom end of said rod and said lower cone body, thereby trapping the compressive setting forces in said expander packing body and said slips.

31. The method of claim 30, further comprising: the steps of seating a plug in the first mandrel bore; supplying fluid pressure to the first mandrel bore through a tubing string including an expansion joint; and directing the said fluid pressure to said piston, whereby said mandrel is additionally urged downwardly by said fluid pressure acting on said plug.

32. The method of claim 30, further comprising: the steps of of providing an abutment on said second mandrel; and elevating said second mandrel to engage said abutment with said retainer plate to release said shearable connection of said rod to said retainer plate to upset the packer.

33. The method of claim 30, further comprising the steps of: connecting a tubing string to said first mandrel; said tubing string including an expansion joint to permit downward movement of said first mandrel to set the packer.

34. The method of claims 27 or 30 further comprising the steps of: applying an additional upwardly directed compressive force to the radially expanded packing body whenever the well annulus fluid pressure below the expanded packing body exceeds the well annulus fluid pressure below the expanded packing body; and trapping said additional upwardly directed compressive force within said radially expanded packing body.

35. The method of claims 27 or 30 further comprising the steps of: positioning a sleeve piston in slidable, sealable relationship between the rod and the expandable packing body; securing said sleeve piston to said lower expander body, whereby a well annulus fluid pressure below the expanded packing body exceeding the well annulus pressure above the expanded packing body moves said piston sleeve upwardly to apply an additional compressive force to said expanded packing body and effecting a unidirectional ratcheting connection between said rod and said piston sleeve to trap said additional compressive force in said expanded packing body.

36. A retrievable packer for subterranean wells comprising: radially expandable packing means radially expandable slip means disposed in axially stacked fluid pressure responsive means for applying a compressive force to said packing means and said slip means to compress same and set said packer; a locking plate mounted above all packing means and said slip means, a continuous rod detachably secured to said locking plate and extending downwardly through said packing means and said slip means; and unidirectional ratcheting means engagable with the bottom portions of said continuous rod to lock said packing means and said slip means in said compressed condition.

37. The apparatus defined in claim 36 further comprising a tubing string supported mandrel extending through said packing means and said slip means; and means connecting said mandrel to one of said packing means and said slip means to run said packer into the well.

38. The apparatus of claim 23, further comprising abutment means on said mandrel engagable with said locking plate to disengage said locking plate from said rod by upward movement of said mandrel, thereby releasing said packer.

39. The apparatus of claim 36 wherein said unidirectional ratcheting means comprises ratchet threads on the bottom portions of said rods; and body lock rings operatively interconnecting said fluid pressure responsive means and said ratchet threads.

40. A retrievable packer for subterranean wells comprising: radially expandable packing means and radially expandable slip means disposed in axially stacked relationship; fluid pressure responsive means for applying a compressive force to said packing means and said slip means to compress same and set said packer; a locking plate mounted above said packing means and said slip means; a rod detachably secured to said locking plate and extending downwardly through said packing means and said slip means; first unidirectional ratcheting means engagable with the bottom portions of said rod to lock said packing means and said slip means in said compressed condition; a piston sleeve surrounding the upper portion of said rod and sealably traversing said radially expandable packing means; means for abuttingly securing said piston sleeve to the bottom surface of said packing means; sealing means intermediate the bore of said piston sleeve and the exterior of said rod, whereby an annulus fluid pressure below said expanded packing element in excess of the annulus fluid pressure above said packing element will produce upward movement of said piston sleeve to further compress said packing means; and second unidirectional ratcheting means engagable between said piston sleeve and the upper portions of said rod to lock said packing means in said further compressed condition.

41. The apparatus defined in claim 40 further comprising: a tubing string supported mandrel extending through said packing means and said slip means; and means connecting said mandrel to one of said packing means and said slip means to run said packer into the well.

42. The apparatus of claim 40 further comprising abutment means on said mandrel engagable with said locking plate to disengage said locking plate from said rod by upward movement of said mandrel, thereby releasing said packer.

43. The apparatus of claim 40, wherein said second unidirectional ratcheting means comprises ratchet threads on the upper portions of said rod extending downwardly into the top portions of said sleeve, and a body lock ring operatively interconnecting said sleeve and said ratchet threads.

* * * * *